US010633819B2

(12) United States Patent
Zhao et al.

(10) Patent No.: US 10,633,819 B2
(45) Date of Patent: Apr. 28, 2020

(54) SELF-LEVEL MECHANISM FOR A CONSTRUCTION MACHINE

(71) Applicant: Guangxi LiuGong Machinery Co., Ltd., Liuzhou (CN)

(72) Inventors: Yunfeng Zhao, Tianjin (CN); Sean Plante, Waverly, IA (US)

(73) Assignee: Guangxi LiuGong Machinery Co., Ltd., Liuzhou, Guangxi (CN)

( * ) Notice: Subject to any disclaimer, the term of this patent is extended or adjusted under 35 U.S.C. 154(b) by 0 days.

(21) Appl. No.: 15/022,430

(22) PCT Filed: Jan. 29, 2016

(86) PCT No.: PCT/CN2016/072661

§ 371 (c)(1),
(2) Date: Mar. 16, 2016

(87) PCT Pub. No.: WO2017/128272

PCT Pub. Date: Aug. 3, 2017

(65) Prior Publication Data

US 2018/0202126 A1 Jul. 19, 2018

(51) Int. Cl.
*E02F 3/43* (2006.01)
*E02F 3/34* (2006.01)

(52) U.S. Cl.
CPC ..... *E02F 3/433* (2013.01); *E02F 3/3411* (2013.01)

(58) Field of Classification Search
None
See application file for complete search history.

(56) References Cited

U.S. PATENT DOCUMENTS 3,001,654 A * 9/1961 Albert ..... B66F 9/065 414/707
3,872,991 A * 3/1975 Pasideris ..... E02F 3/3405 414/707
6,397,967 B1 6/2002 McIlwraith
7,736,117 B2 6/2010 Harshberger et al.
8,226,344 B2 7/2012 Osanai et al.
8,886,415 B2 11/2014 Shatters et al.
9,410,304 B2 8/2016 Taylor et al.
(Continued)

FOREIGN PATENT DOCUMENTS

CN 101842536 A 9/2010
CN 102829007 A 12/2012
(Continued)

OTHER PUBLICATIONS

European Patent Office; Partial European Search Report, Issued in Connection to EP16163055.3; dated Jun. 2, 2017; 7 pages; Europe.
(Continued)

*Primary Examiner* — Michael S Lowe
(74) *Attorney, Agent, or Firm* — Young Basile Hanlon & MacFarlane, P.C.

(57) ABSTRACT

Disclosed is a self-level mechanism for controlling a tilting movement of an equipment (15) mounted to an equipment connector (5) of a main arm (3) of a lifting arrangement of a construction machine, preferably a wheel loader (1), upon pivoting said main arm (3). The self-level mechanism is configured to at least partially compensate any tilting movement of the equipment (15).

19 Claims, 41 Drawing Sheets

(56) References Cited

U.S. PATENT DOCUMENTS

| | | | |
|---|---|---|---|
| 2008/0041805 | A1 | 2/2008 | Jantti |
| 2009/0003984 | A1 | 1/2009 | Osanai et al. |
| 2009/0110530 | A1 | 4/2009 | Harshberger et al. |
| 2012/0218424 | A1 | 8/2012 | Gotoh et al. |
| 2012/0321425 | A1 | 12/2012 | Shatters et al. |
| 2015/0275469 | A1 | 10/2015 | Fredrickson et al. |
| 2015/0308072 | A1 | 10/2015 | Taylor et al. |

FOREIGN PATENT DOCUMENTS

| | | | |
|---|---|---|---|
| CN | 104074213 | A | 10/2014 |
| CN | 105035776 | A | 11/2015 |
| DE | 2853775 | A1 | 7/1980 |
| EP | 1889537 | A2 | 2/2008 |
| GB | 2345046 | A | 6/2000 |
| JP | S5826128 | A | 2/1983 |
| WO | 2017128272 | A1 | 8/2017 |

OTHER PUBLICATIONS

European Patent Office; Extended European Search Report, Issued in Connection to EP16163055.3; dated Oct. 5, 2017; 7 pages; Europe.

State Intellectual Property Office of the P.R. China; PCT International Search Report, Issued in Connection to PCT/CN2016/072661; dated Oct. 25, 2016; 2 pages; China.

State Intellectual Property Office of the P.R. China; PCT Written Opinion of the International Searching Authority, Issued in Connection to PCT/CN2016/072661; dated Oct. 25, 2016; 4 pages; China.

European Patent Office; English Translation of CN101842536; 1 page; printed Oct. 31, 2017.

European Patent Office; English Translation of CN102829007; 1 page; printed Oct. 31, 2017.

European Patent Office: English Translation of CN105035776; 1 page; printed Oct. 31, 2017.

First Office Action in corresponding Chinese Patent Application No. CN2016102755024, dated Dec. 14, 2018.

* cited by examiner

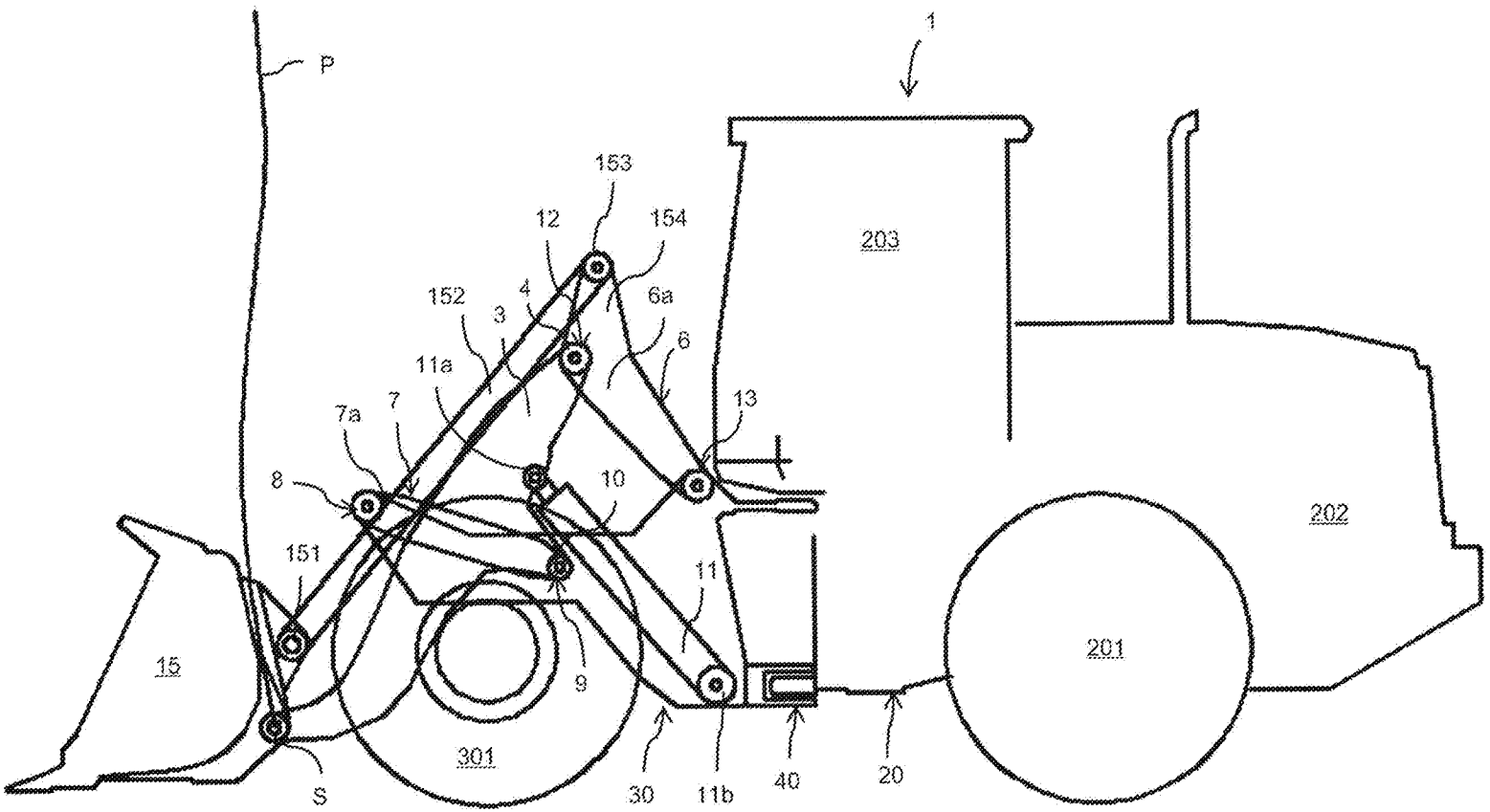
Fig. 25
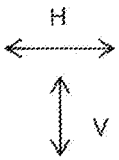

SELF-LEVEL MECHANISM FOR A CONSTRUCTION MACHINE

The present invention relates to a self-level mechanism for a construction machine. In particular, the present invention relates to a self-level mechanism which can be advantageously applied to a wheel loader.

TECHNICAL BACKGROUND

Construction machines include those which are used for lifting heavy loads such as in mining or similar operations. Mobile construction machines having a lifting arrangement are known such as wheel loaders or the like. For such applications it is crucial to provide a maximum loading and lifting capacity for the lifting arrangement as this is the main factor affecting the operational efficiency of such construction machines. An operation of construction machines using lifting arrangements includes a loading operation of the material to be lifted at a lower level, a lifting operation for lifting the load to a higher level and an unloading operation e.g. for dumping or unloading the lifted load at the higher level.

In specific applications using a lifting arrangement which is mounted at the front area of mobile construction machines, the lifting capacity is not only limited by the available power driving actuators used for lifting the load. Rather, a weight distribution of such mobile construction machines is a limiting factor restricting the lifting capacity of such lifting arrangements as the mobile construction machine must remain stable in the course of the lifting operation. Consequently, variations of the weight distribution of the mobile construction machines or an increase of the total weight of the machine are considered in order to enhance the lifting capacity of the lifting arrangement. However, such variations in weight distribution or even an increase of the total weight of the mobile construction machine have clearly a negative influence on the drivability and the overall weight of the construction machine. Moreover, drive sources for driving the machine must be designed for such an increased weight of the machine which deteriorates the overall efficiency in view of a specified maximum lifting capacity. The above disadvantages have been accepted previously in order to provide construction machine having the desired lifting capacity.

The material to be loaded is typically loaded on an equipment which is mounted on a front end of a main arm of the lifting arrangement. Thus, the orientation of the equipment tends to be negatively affected by a pivoting movement of the main arm.

SUMMARY OF THE INVENTION

It is the object of the present invention, to provide an improved self-level mechanism for a construction machine which controls a tilting movement of an equipment.

The object is solved by a lifting arrangement for a construction machine having the features of claim 1. Further advantageous developments of the invention are defined in the dependent claims.

According to a first aspect of the present invention, a self-level mechanism for controlling a tilting movement of an equipment mounted to an equipment connector of a main arm of a lifting arrangement of a construction machine, preferably a wheel loader, upon pivoting said main arm is provided. The self-level mechanism is configured to at least partially compensate any tilting movement of said equipment.

According to an embodiment of the invention, the self-level mechanism is configured so as to provide a counter-rotation of said equipment with respect to a pivoting movement of said main arm.

According to an embodiment of the present invention, the self-level mechanism is kinematically coupled with the lifting arrangement and the equipment.

According to an embodiment of the present invention, the self-level mechanism further comprises a kinematic chain comprising at least two linking devices and joints at which at least two linking devices are connected to each other.

According to an embodiment of the present invention, the kinematic chain comprises a first kinematic chain couplable to a tilt connector of said equipment at one end.

Preferably, the first kinematic chain is configured as a Z-kinematic.

According to an embodiment of the present invention, at least one linking device of the first kinematic chain section is length adjustable.

Preferably, the at least one linking device comprises an actuator.

According to an embodiment of the present invention, the self-level mechanism further comprises a second kinematic chain coupled to the first kinematic chain at a coupling joint. Furthermore, the second kinematic chain is coupled to at least one of a frame portion of the construction machine and the main arm of said lifting arrangement. In addition, the second kinematic chain is further configured such that a distance between the coupling joint and the equipment connector changes upon pivoting the main arm.

According to an embodiment of the present invention, the second kinematic chain comprises a support element of the lifting arrangement. The support element is connected to the main arm at a pivot connector provided on the main arm at one end. Furthermore, the support element is connected to the frame portion at another end. Also, the second kinematic chain comprises an auxiliary link coupled to the coupling joint at one end and coupled to the frame portion at the other end.

According to an embodiment of the present invention, the coupling joint is arranged rotatably about an axis of the pivot connector.

According to an embodiment of the present invention, the second kinematic chain is a closed kinematic chain in the form of a parallelogram in which the support element and the auxiliary link are arranged substantially parallel to each other.

According to an embodiment of the present invention, one of the linking devices of the second kinematic chain is rotatably coupled to the main arm at a supporting portion arranged between two joints of the linking device.

According to an embodiment of the present invention, the second kinematic chain is configured such that two links of said second kinematic chain are rotatably coupled to the main arm.

According to an embodiment of the present invention, the one linking device of the linking devices is coupled to the first kinematic chain at one joint of the two joints. The joint functions as the coupling joint. Furthermore, the one linking device is coupled to the frame structure of said construction machine via a parallelogram kinematic.

According to an embodiment of the present invention, the one joint is operatively coupled to the parallelogram kinematic at a middle section of a parallelogram kinematic link by means of an intermediate link.

According to a further aspect of the present invention, a construction machine comprising a lifting arrangement and a self-level mechanism as described above is disclosed. The lifting arrangement is preferably a lifting arrangement for a construction machine such as a wheel loader as described in the following. In other words, lifting arrangements as described below can be suitably combined with the self-level mechanisms as described before. The self-level mechanisms as described above can be used in combination with all of the below described lifting arrangements as well as with specific lifting arrangements as set out in the below embodiments.

According to a further aspect of the present invention, a lifting arrangement for a construction machine having a frame arrangement with a front frame portion and a rear frame portion is provided. The lifting arrangement can be suitably used in connection with the self-level mechanism as described above. The lifting arrangement is mountable to said frame arrangement, preferably to said front frame portion of said construction machine. According to the present aspect of the invention, the lifting arrangement comprises the following:

a main arm which is provided with a pivot connector at a proximate end thereof and an equipment connector at a distal end thereof, a main arm support means for pivotably supporting said pivot connector of said main arm, wherein said main arm support means is moveable in a direction which includes at least a component in the front-rear direction with respect to said frame arrangement, an actuator for pivoting said main arm about said pivot connectors such that said equipment connector is movable between a lowered position and a lifted position, and a guiding means which is engaged to said main arm at a guided portion of said main arm positioned between said pivot connector and said equipment connector, wherein upon pivoting said main arm between said lowered position and said lifted position, said guided portion is guided by said guiding means along a curved path.

According to the invention, the main arm of said lifting arrangement is pivotable in order to provide a lifting movement at said equipment connector. In addition, a pivot center about which the main arm is pivoted is not stationary with respect to the frame arrangement of the construction machine. Rather, the pivot center of the main arm is supported at said support means which is movable in a direction which includes at least a component in the front-rear direction with respect to said frame arrangement.

Based on the guiding means designed according to the invention, the pivoting movement of the main arm effects a movement of the support means in order to provide a specific kinematic pattern of said movement upon moving the equipment connector between a lowered position and a lifted position.

According to an embodiment of the invention, said curved path along which said guided portion is guided by said guiding means is bulged towards said main arm support means.

Based on this structure, the equipment connector follows a specified path by guiding said guided portion of said main arm along said curved path which is bulged towards said main arm support means which effects a corresponding movement of said main arm support means in order to vary the position of the pivot center of the main arm upon moving said equipment connector between said lowered position and said lifted position.

According to an embodiment of the invention, by guiding said guided portion along said curved path upon pivoting said main arm between said lowered position and said lifted position, said main arm support means is forcedly moved in a direction which includes at least a component in the front-rear direction with respect to said frame arrangement.

Specifically, in this embodiment, the pivot center of the main arm is forcedly shifted or displaced in the front-rear direction upon moving said equipment connector between said lowered position and said lifted position. No further designated actuators for shifting or displacing said main arm support means are required by using said guiding means.

According to an embodiment of the invention, by guiding said guided portion along said curved path upon pivoting said main arm between said lowered position and said lifted position via an intermediate position, said main arm support means is forced in a rearward shifted position when said main arm passes said intermediate position, whereas said main arm support means is forced in a forward shifted position when said main arm approaches said lowered position or said lifted position, i.e. when moving from said intermediate position towards said lifted position or said lowered position.

According to this concept, the pivot center of the main arm is positioned further rearward when said main arm is in an intermediate position located between said lowered position and said lifted position compared to the situation in which said main arm is positioned in said lowered position or said lifted position. This means, that the kinematic pattern of the equipment connector upon moving the same between said lowered position and said lifted position is influenced by the position of said main arm support means.

According to an embodiment of the invention, a path of said equipment connector upon pivoting said main arm between said lowered position and said lifted position deviates from a circular path determined by a radius defined by an effective length of said main arm.

The effective length of said main arm is defined by a distance, i.e. a direct line, between said pivot center arranged at said main arm support means and said equipment connector. According to the basic concept of the present invention, the main arm, in particular said equipment connector, can be moved between said lowered position and said lifted position wherein the path of movement of said equipment connector does not correspond to the circular path having a radius corresponding to the effective length of said main arm. As consequence, a specified degree of freedom for determining or setting the movement path of said equipment connector can be provided. In particular, the movement path can be determined such that the objective problem underlying the present invention can be achieved, i.e. the loading or lifting capacity of the construction machine upon lifting a load by pivoting said main arm between said lowered position and said lifted position can be increased without affecting the total efficiency of the construction machine.

According to an embodiment of the invention, said path of said equipment connector upon pivoting said main arm between said lowered position and said lifted position follows a substantially vertical path. As stated above, the inventive arrangement allows the determination of a specified path along which said equipment connector follows upon lifting a load by pivoting said main arm between said lowered position and said lifted position. According to the present embodiment, the equipment connector follows a substantially vertical path which means that the movement of the equipment connector upon pivoting said main arm is maintained within a predetermined range. In particular, the predetermined range defining said substantially vertical path according to the present invention allows a specific deviation from a line vertically extending from the equipment connector in the lowermost position. It follows from the above that the substantially vertical path is not limited to a strictly vertically arranged line along which the equipment connector moves. Rather, any path which is limited within a range the width of which extends in the front-rear direction with respect to the construction machine is sufficient for achieving the solution according to the present invention.

Preferably, the deviation of the equipment connector from the vertical line extending from the equipment connector in the lowermost position is restricted to a specific deviation in the front-rear direction in order to limit the variance in the tilting momentum applied to the construction machine which is caused by the force exerted upon lifting the load. As consequence, a tilting moment exerted to the construction machine by the load in the intermediate position of the equipment connector can be limited to a specific extent thus enhancing the overall efficiency of the construction machine.

According to an embodiment of the invention, said main arm support means includes a main arm support link having a first end and a second end. The first end is pivotably connected to said pivot connector of said main arm and said second end is pivotably connected to said front frame portion. Said first end is movable in the direction which includes at least a component in the front-rear direction with respect to said frame arrangement.

According to the above embodiment, the arrangement for movably supporting the pivot connector of said main arm is realized by said main arm support link which provides a support for said pivot center of said main arm about which the main arm is pivoted, said pivot connector being movable at least with a component in the front-rear direction with respect to the construction machine. Although the main arm support link provides a circular path at its first end, the arrangement of said main arm support link can be such that a component of this circular movement is aligned to the front-rear direction with respect to the construction machine. In this case, the main arm support link extends towards the upper area in order to provide said component in the front-rear direction with respect to the construction machine when said main arm support link is pivotably moved upon lifting said equipment connector of said main arm. As alternative, said main arm support link can be arranged such that said main arm support link extends towards the downward area as long as it provides for a movement of said pivot center of said main arm which includes at least a component in the front-rear direction with respect to said frame arrangement.

According to an embodiment of the invention, said main arm support means includes a sliding element which is mounted to said front frame portion, said pivot connector of said main arm being pivotably and slidably connected to said sliding element, such that said pivot connector is moveable in a direction which includes at least a component in the front-rear direction with respect to said frame arrangement.

In the above alternative, the movement of said pivot connector of said main arm is achieved by allowing a sliding movement including a component in the front-rear direction with respect to the construction machine. The sliding element can be embodied as one or multiple guiding rails. The pivot connector of said main arm can be slidably mounted to the above mentioned one or multiple guiding rails. The one or multiple guiding rails can be straight or bent or otherwise shaped guiding rails.

According to an embodiment of the invention, said guiding means includes a guiding arm having a first end and a second end. The first end is pivotably mountable to said front frame portion and said second end is pivotably mounted to said main arm at said guided portion of said main arm positioned between said pivot connector and said equipment connector.

According to this embodiment, the movement of the guided portion of said main arm upon lifting said main arm is well-determined by using a very simple means. In particular, using pivotable linkages between elements forming the lifting arrangement enhances the lifetime and minimizes maintenance work. Moreover, in the context of the basic concept of the lifting arrangement according to the present invention, the kinematic pattern of movement of the equipment connector can be achieved as desired without the need of any control means or the like.

According to an embodiment of the invention, upon pivoting said main arm between said lowered position and said lifted position, the rotational direction of the pivoting movement of said main arm is opposite to the rotational direction of the pivoting movement of the above mentioned guiding arm. Due to this concept, the lifting arrangement can be designed as compact structure which is preferable in particular when applying the lifting arrangement to the front portion of the frame arrangement of the construction machine. Moreover, with the arrangement according to the above embodiment, the specified movement path of the equipment connector can be achieved in cooperation with the pivoting main arm and the pivoting guiding arm which rotate in opposite directions upon a lifting movement of the equipment connector.

According to an embodiment of the present invention, said guiding arm is equipped with an adjusting means for adjusting an effective length of said guiding arm. In this case, the effective length of said guiding arm is defined by the distance between a pivoting bearing at the first end of the guiding arm and a pivoting bearing at the second end of the guiding arm. By using an adjusting means for adjusting the effective length of said guiding arm, the degree of freedom in setting or determining the path along which the equipment connector is moved upon a lifting operation can be further increased.

According to an embodiment of the invention, said adjusting means is embodied as linear actuator for adjusting the distance between the first end and the second end of said guiding arm, in particular, between said pivoting bearing at the first end and said pivoting bearing at said second end of said guiding arm. In a preferred embodiment, the linear actuator is structured as hydraulic cylinder. Hydraulic actuators are present in the majority of construction machines and, therefore, this embodiment can be achieved without the need to provide additional driving means or the like. In any case, the invention can also be realized by operating the lifting arrangement without changing the effective length of said guiding arm. Rather, the adjusting means is provided in order to realize an option for enhancing the degree of freedom for moving the equipment connector.

According to an embodiment of the invention, said guiding means includes a guiding rail mounted to said front frame portion which is slidingly engaged to said guided portion of said main arm, said guiding rail providing said curved path. According to this alternative, said curved path for forcedly moving the guided portion of said main arm along said curved path is realized by the combination of said guiding rail which guides an element of said main arm, in particular, said guided portion. In this context, any type of guiding rail can be used as long as a specified path can be provided along which the guided portion of said main arm is guided. In order to realize the guiding of said guiding portion of said main arm, a sliding element can be provided which engages said guiding rail and which is arranged for sliding along the guiding path of said guiding rail.

According to an embodiment of the invention, said curved path, along which said guided portion is guided by said guiding means is a circular path. Providing a circular path is achieved with simple means such as a link which is pivotably supported at one end. The same advantage applies to the guiding means being a guiding rail as a guiding rail with a circular path can be easily produced. Moreover, such elements providing a circular path can be replaced without high machining effort which is a very important advantage of the simple arrangement provided by the present invention. In addition, in combination with the further elements of the lifting arrangement, the object of providing the specified path of the equipment connector which provides the above discussed advantage can be achieved as desired.

According to an embodiment of the invention, at least one of a bucket and a lifting fork for lifting heavy loads is tiltably mounted to said equipment connector. A bucket can be used to load, lift and unload bulky matter such as in mining or the like. A lifting fork for lifting heavy loads can be used to lift large single piece loads. Both can be understood as equipment to be mounted at the equipment connector. Preferably, the equipment mountable to said equipment connector is arranged with the option of tilting the equipment. The above mentioned bucket or lifting fork are not limiting the invention. Rather, any equipment can be mounted to the equipment connector with our without tilting option as long as a lifting operation is involved.

According to a further aspect of the present invention, a wheel loader is provided which has an articulating frame arrangement consisting of a front frame portion and a rear frame portion which are articulatingly interconnected for providing an articulating steering, wherein the wheel loader comprises a lifting arrangement according to one of the above mentioned embodiments.

As discussed above, the lifting arrangement can be constructed as compact structure while the advantage of providing the specified path of the equipment connector can be achieved. When applied to a wheel loader, such a compact arrangement is particularly advantageous due to the fact that an articulating steering is provided between a front frame portion and a rear frame portion.

Accordingly, it is a specific advantage of this aspect of the present invention, that elements forming said lifting arrangement are supported by said front frame portion of said articulating frame arrangement and are articulated together with said front frame portion with respect to said rear frame portion upon steering actions.

In this case, the equipment connected to the equipment connector is preferably provided in front of the front frame portion, wherein the elements of said lifting arrangement are supported by said front frame portion. As the front frame portion in an articulating frame arrangement substantially follows the direction of the front wheels, the operation of the wheel loader following this concept can be operated without any surprising changes in behavior compared to a standard wheel loader. However, it is also possible to provide a part of the elements forming the lifting arrangement at the rear frame portion. Also, it is possible to provide all elements of the lifting arrangement at the rear frame portion depending on the specific needs.

According to the above invention, the lifting arrangement provides a movement pattern of the equipment connector along a specified path. This specified path is designed such that the protruding length of the equipment connector carrying the equipment is reduced in the intermediate position of lifting compared to a prior art lifting arrangement in which the main arm is pivotably mounted at a stationary pivot center. As consequence, the tilting moment exerted to the construction machine by the load acting on said equipment connector can be reduced in the intermediate position of said main arm compared to prior art lifting arrangements. Based on this advantage, the loading or lifting capacity which is limited by the maximum tilting moment exerted in the intermediate position of the main arm can be increased without changing the overall weight distribution or increasing the total weight of the construction machine. Due to this fact, the efficiency of the construction machine is enhanced. From a different perspective, it is possible to provide a construction machine with a predetermined lifting or loading capacity in which the total weight of the construction machine can be reduced such that all settings including wheels, bearings, drive forces and the like can be reduced in capacity with respect to a prior art construction machine. As result, the fuel consumption of such a novel construction machine will be reduced dramatically when compared to prior art machines having the same lifting or loading capacity.

It is noted that the above embodiments and alternatives can be applied as single measure or in combination. Moreover, it is explicitly noted that the application of the lifting arrangement is not limited to wheel loader having an articulating frame arrangement. Due to the compact structure of the inventive lifting arrangement, the application to any construction machine provides the same advantage as discussed above. The same applies for the self-level mechanism.

BRIEF DESCRIPTION OF THE DRAWINGS

The invention is explained based on the enclosed drawings showing an exemplary construction machine equipped with a lifting arrangement according to various embodiments and modifications. It is noted that the following drawings should not be considered as limiting the invention set out in the claims. Moreover, the illustrated construction machine is merely an example and the lifting arrangement according to the invention is applicable to various types of construction machines.

FIG. 25 illustrates a construction machine equipped with a lifting arrangement according to a sixth example in a lowered position;

DETAILED DESCRIPTION OF THE EMBODIMENTS

Figure 1:
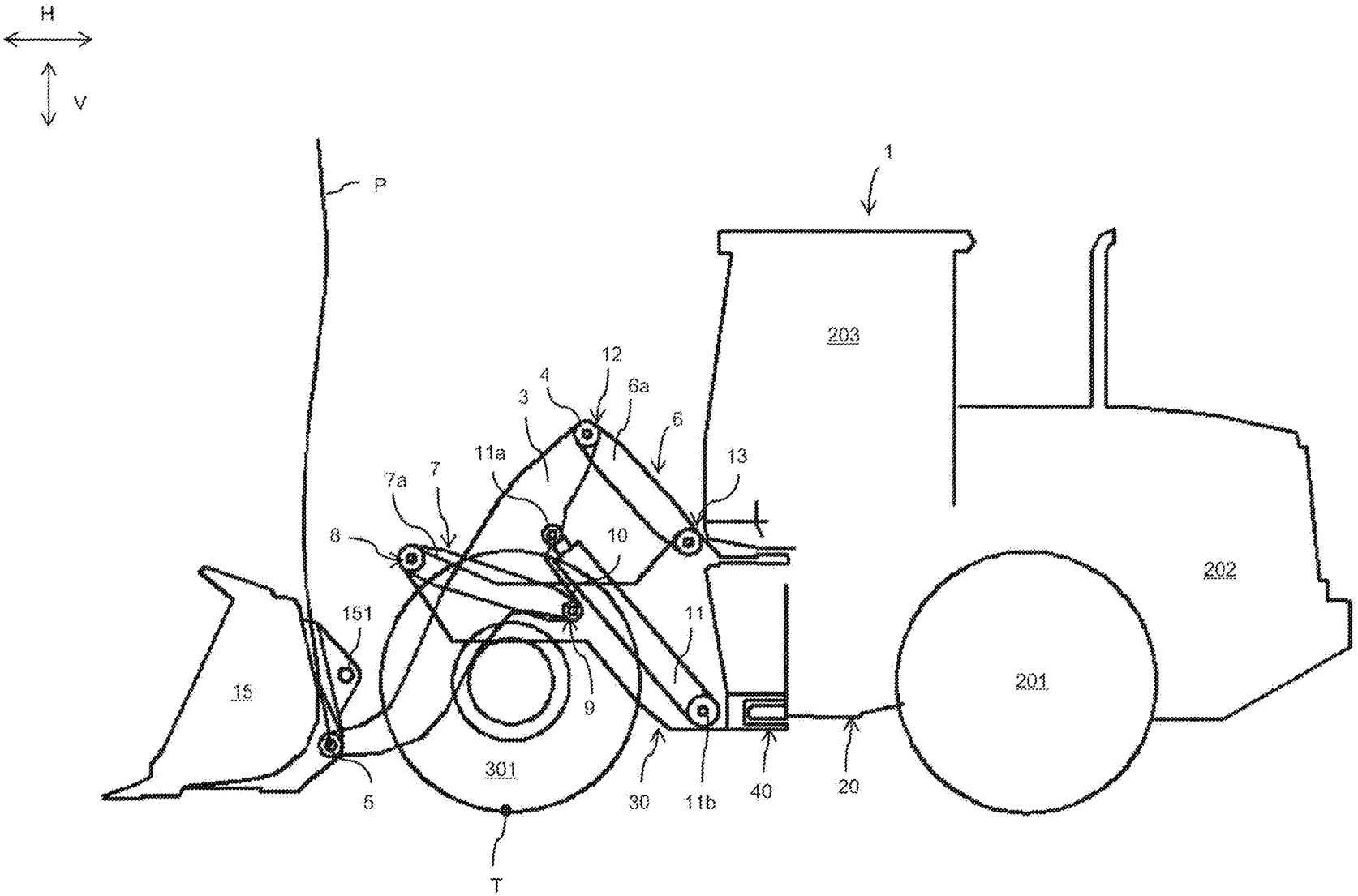
FIG. 1 illustrates a construction machine equipped with a lifting arrangement according to a first example in a lowered position.

In the following, examples, embodiments and modifications of the present invention are explained in detail based on the drawings. It is noted that the below discussed embodiments, examples and modifications can be combined with each other and the invention is not specifically restricted to the structure and arrangement of the specific embodiments and modifications discussed below. Furthermore, it is noted that similar or equivalent elements in the drawings can be denoted with the same reference signs, even if their appearance and structure differs slightly.

General Overview

The present invention relates to a self-level mechanism which is applicable to construction machines in general. Furthermore, the present invention relates to a combination of a self-level mechanism with a lifting arrangement which is applicable to construction machines in general. In the following embodiments, the self-level mechanism and the lifting arrangement are illustrated and explained as structure of a construction machine which is embodied as wheel loader. However, the specific application of the self-level mechanism and the lifting arrangement according to the present invention is not limited to the application to a wheel loader. Rather, the self-level mechanism and the lifting arrangement according to the present invention can be applied to drivable construction machines of any type such as loaders having wheels or crawler track chains or even a combination of both. Moreover, the steering type is not limited to the below discussed optional articulating steering arrangement. Rather, the self-level mechanism and the lifting arrangement are applicable to construction machines having any type of steering arrangements such as articulating steering arrangements, skid steering arrangements or any other type.

The construction machine to which the self-level mechanism and the lifting arrangement according to the present invention is applicable is briefly explained based on the illustration of FIG. 1. FIG. 1 shows the construction machine 1 in a simplified side view. Elements which are not essential for the invention are omitted.

The construction machine 1 comprises a front frame portion 30 and rear frame portion 20. In the example according to FIG. 1, a pair of front wheels 301 is mounted to the front frame portion 30 and a pair of rear wheels 201 is mounted to the rear frame portion 20. The front frame portion 30 is mounted to the rear frame portion 20 with an articulating steering arrangement 40. The articulating steering arrangement 40 is well known to the skilled person and comprises one or multiple bearings for providing an articulating mount between the front frame portion 30 and the rear frame portion 20 with a pivoting axis being arranged substantially along the vertical axis of the construction machine 1, i.e. perpendicular with respect to the longitudinal direction of the construction machine 1. The articulating steering arrangement 40 provides a tilting between the front frame portion 30 and the rear frame portion 20 in order to provide a steering by changing the angle enclosed between the rotation axis of the front wheels 301 and the rotating axis of the rear wheels 201. The articulating steering arrangement 40 can be driven by a not illustrated actuator, such as a hydraulic actuator. The type and structure of the articulating steering arrangement 40 is not essential to the invention and can be adapted as required.

The construction machine 1 according to the example shown in FIG. 1 comprises an operator's cab 203 which is mounted to the rear frame portion 20. Inside the operator's cab 203, space for the operator is provided and the required operating and control elements which are not illustrated are accessible by the operator. The operator's cab 203 comprises not illustrated windows in order to provide visibility of the surrounding field for the operator.

An engine compartment 202 is provided at the rear frame portion 20 which houses one or multiple power sources for providing power required to operate the construction machine 1. The power sources can include but are not limited to an internal combustion engine, such as a Diesel engine, which can be coupled to further equipment such as hydraulic pumps, generators and the like. The power source is used to provide power for driving the front wheels 301 and/or the rear wheels 201 as well as for providing power for actuators besides other elements of the construction machine.

The front frame portion 30 extends in the forward direction with respect to the rear frame portion 20. In the present example, the front frame portion 30 is located in front of the operator's cab 203 and the engine compartment 202. However, the application of the lifting arrangement according to the present invention is not limited to the construction machine 1 having such an arrangement.

Upon a steering operation, the front frame portion 30 tilts with respect to the rear frame portion 20, the operator's cab 203 and the engine compartment 202. However, it is also possible to provide a modified steering arrangement such as a single wheel steering, front wheel steering or rear wheel steering while the articulating steering arrangement is omitted or provided only as option.

In the following, the lifting arrangement which is usable in connection with the self-level mechanism according to the present invention is explained in various examples, wherein the lifting arrangement is mounted to the front frame portion 30 of the above explained exemplary construction machine 1 embodied as wheel loader.

First Example

The lifting arrangement according to the first example comprises a main arm 3 having a pivot connector 4 at a proximate end and an equipment connector 5 at a distal end thereof. The pivot connector 4 is pivotally supported at a main arm support means 6 which includes a main arm support link **6*a* in the present example. The main arm support link 6*a* has a first end 12 and a second end 13, the first end 12 being pivotably connected to the pivot connector 4 of the main arm 3 and the second end 13 being pivotably connected to an element of the front frame portion 30. The connection between the pivot connector 4 of the main arm 3 and the first end 12 of the main arm support link 6*a* can be provided as bearing arrangement of a suitable type in order to provide a sliding rotation of the main arm 3 with respect to the main arm support link 6*a***.

The main arm support link **6*a* is pivotably mounted to the front frame portion 30 at its second end 13. In order to provide such a pivotable mount of the main arm support link 6*a* to the front frame portion 30, a rotating bearing of a suitable type is arranged for providing the pivotable movement of the main arm support link 6*a* with respect to the front frame portion 30**.

The main arm support link **6*a* is arranged such that a rotation or pivoting movement of the main arm support link 6*a* provides a movement of the first end 12 in a direction which at least includes a component in the front-rear direction of the construction machine 1. For this reason, the main arm support link 6*a* is directed in an upwards direction with a specific inclination from the vertical direction in the situation in FIG. 1**.

The main arm 3 comprises a guided portion 10 which is provided between the pivot connector 4 and the equipment connector 5. In the present example, the guided portion 10 is also offset by a predetermined amount from a line connecting the pivot connector 4 and the equipment connector 5. However, this offset is not essential for the present invention and rather a preferred arrangement.

The lifting arrangement according to the present invention further includes a guiding means 7 which includes in the example shown in FIG. 1 a guiding arm **7*a* having a first end 8 and a second end 9. The first end 8 is pivotably mounted to the front frame portion 30 and the second end 9 is pivotably mounted to the main arm 3 at the guided portion 10. The second end 9 is pivotably mounted to a bearing of a suitable type provided in the area of the guided portion 10 of the main arm 3 in order to provide a pivotable movement of the guiding arm 7*a* relative to the main arm 3. On the other hand, the first end 8 is pivotably mounted to the front frame portion with a bearing of a suitable type in order to provide a pivotable movement of the guiding arm 7*a*** with respect to the front frame portion.

An actuator 11 is provided in the lifting arrangement. The actuator has a first end **11*b* which is pivotably mounted to the front frame portion 30 and a second end 11*a* which is pivotably mounted to the main arm 3. The actuator is embodied as linear actuator such as a hydraulic actuator in the present example but not limited thereto. Upon operating the actuator 11, the distance between the first end 11***b* and the second end 11*a* can be changed e.g. by introducing pressurized fluid into pressure chambers of the actuator 11.

At the equipment connector 5 of the main arm 3, a bucket 15 is provided which is an example of equipment which can be mounted to the main arm. The bucket comprises a tilt connector 151 for tiltably operating the bucket. The arrangement for tilting the bucket 15 is not illustrated in FIG. 1 and will be explained in further detail below.

In the exemplary arrangement shown in FIG. 1, the guiding arm 7*a* is directed rearwards with respect to the first end 8 of the guiding arm 7*a*. In FIG. 1, the lifting arrangement is shown in a position which is defined as lowered position in which the bucket 15 is positioned at a lowermost position in which the bucket is able to admit material to be lifted and touches the ground. It is, however, possible to provide a lifting range which extends below the ground limit if needed.

In the following, an operation of the lifting arrangement according to the present invention is explained in detail based on the illustrations of FIGS. 1-3.

In FIG. 1, the lifting arrangement is illustrated in the lowered position. In this situation, the main arm is rotated downwards as illustrated in FIG. 1. This is achieved by retracting the actuator 11 which is provided for operating the main arm 3. The position of the main arm 3 is determined by the linkage between the guiding arm 7*a* and the main arm support link 6*a*. In other words, the position of the pivot connector 4 of the main arm 3 can be changed by changing the rotational position of the main arm support link 6*a*, whereas the guiding arm 7*a* determines, due to its rotational connection between the front frame portion 30 and the guided portion 10 of the main arm 3, the position of the pivot connector 4 depending on the rotational position of the main arm 3. As such, the lifting arrangement provides a link-based transmission which uniquely determines the position of the main arm 3.

Upon actuating the actuator 11, the main arm 3 is rotated in the clockwise direction in FIG. 1. With this rotation, the main arm 3 is rotated with respect to the main arm support link 6*a*. At the same time, the guiding arm 7*a* is rotated in the counter clockwise direction. When the guiding arm 7*a* rotates in the counter clockwise direction, the guided portion 10 of the main arm 3 is forced along a circular path due to the constant distance between the first and second ends 8, 9 of the guiding arm 7*a*. The circular path provided by the rotation of the guiding arm 7*a* is bulged towards the main arm support means including, in the present example, the main arm support link 6*a*.

Figure 2:
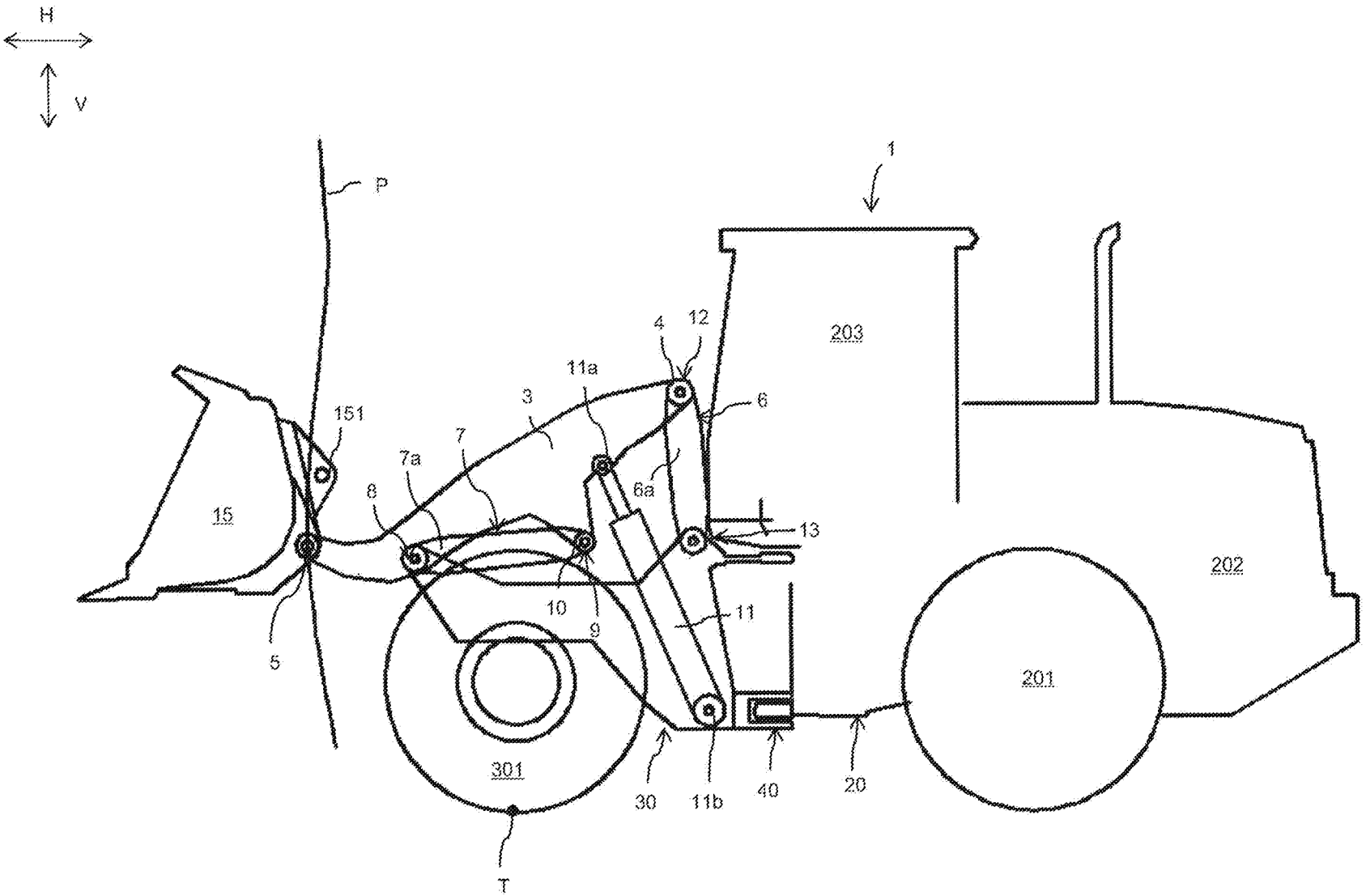
FIG. 2 illustrates a construction machine equipped with a lifting arrangement according to the first example in an intermediate position.

FIG. 2 shows the lifting arrangement of FIG. 1 in an intermediate position which is lifted from the lowered position by a predetermined amount. As can be seen, the guiding arm 7*a* is rotated from the position shown in FIG. 1 in the counter clockwise direction. In this context, the position of the second end 9 of the guiding arm 7*a* has moved with a component of movement in the rearward direction with respect to the construction machine 1. In the same context, the main arm 3 has rotated in the clockwise direction and the bucket 15 mounted to the equipment connector has lifted by a predetermined amount. Due to the fact, that the guided portion 10 of the main arm 3 is forced in the rearward direction by the predetermined movement path of the second end 9 of the guiding arm 7*a*, the main arm support link 6*a* is rotated in the clockwise direction about its second end 13 which is mounted to the front frame portion 30. Therefore, the position of the first end 12 of the main arm support link 6*a* is moved together with the pivot connector 4 of the main arm 3 in the rearward direction with respect to the construction machine.

Figure 3:
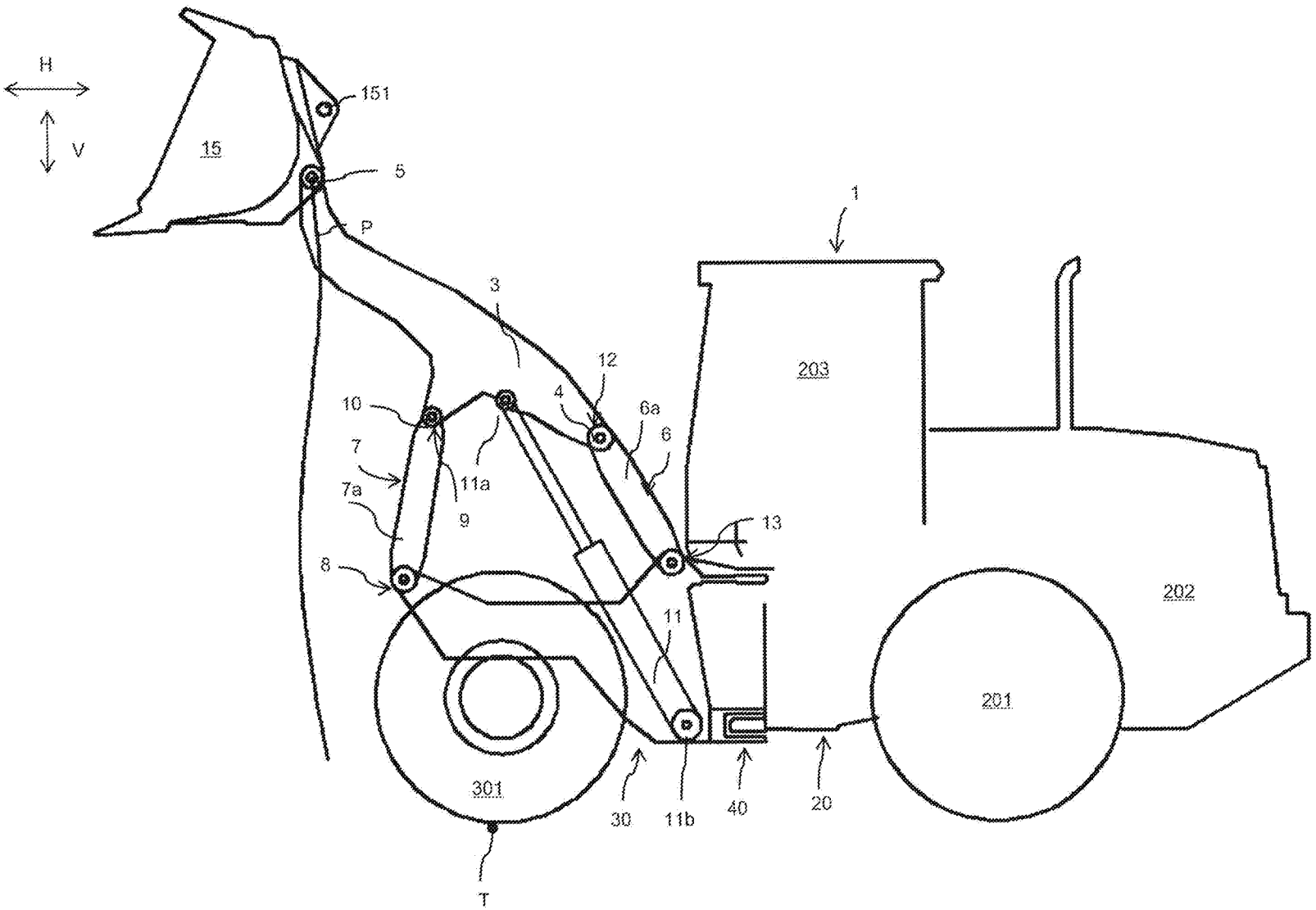
FIG. 3 illustrates a construction machine equipped with a lifting arrangement according to the first example in a lifted position.

Upon a further operation of the actuator 11, the main arm 3 is further rotated in the clockwise direction and reaches a lifted position shown in FIG. 3. In this position, the bucket 15 mounted to the equipment connector 5 of the main arm 3 has reached a position which is higher than the intermediate position shown in FIG. 2. This position is the maximum lift position of the bucket 15 which can be achieved with the example shown in FIGS. 1-3. Upon further rotating the main arm 3 in the clockwise direction, the guiding arm 7*a* is further rotated in the counterclockwise direction and forces the guided portion 10 of the main arm 3 further along the circular path. As the second end 9 of the guiding arm 7*a* has moved forward with respect to the position shown in FIG. 2, the main arm support link 6*a* is rotated in the counterclockwise direction from the position shown in FIG. 2. Therefore, the position of the first end 12 supporting the pivot connector 4 of the main arm 3 is further forward compared to the position thereof shown in FIG. 2.

Based on the above operation, the bucket 15 can be moved from the lowered position shown in FIG. 1 to the lifted position shown in FIG. 3 through the intermediate position shown in FIG. 2. Based on the inventive arrangement comprising the guiding arm 7*a* and the main arm support link 6*a*, the equipment connector 5 is forced along a predetermined movement path which is shown as path P in the drawings. In the present illustration, the path P is formed with an S-shape but basically follows a vertical path throughout the movement of the equipment connector from the lower most position to the upper most position. In particular, the path P deviates from a circular path which is achievable with prior art lifting arrangements in which the pivot connector 4 of the main arm 3 is immovably and stationary with respect to a frame portion of the construction machine 1. According to the present invention, the movement of the pivot connector 4 of the main arm is achieved by providing the movable support means 6 and the guiding means 7 which forces the main arm 3 to a specified movement pattern leading to a basically vertical movement range of the equipment connector 5.

In the following, the advantages of the present invention are explained based on the above example. The lifting capacity of construction machines of this type are crucial for the operational efficiency of the machine. In case that the construction machine is supposed to the operated for lifting high loads from the lowered position of the bucked to the lifted position of the bucket, the tilting moment exerted by the load to the construction machine 1 must be considered. In this context, the point of contact of the front wheels 301 must be considered as tilting point T of the construction machine which is indicated in FIGS. 1-3 at one of the front wheels 301. As the bucket protrudes from the tilting point T in the forward direction, a tilting moment in the counterclockwise direction in FIG. 1 is exerted to the construction machine. As countermeasure, the weight distribution of the construction machine in particular at the rear side thereof must be appropriately determined.

Considering a prior art lifting arrangement, upon lifting a load based on a main arm having an equipment connector which follows a circular path upon a movement between the lowered position and the lifted position, the protruding distance of the equipment connector and the load acting on the equipment connector protrudes further in the intermediate position than in the lowered position or the lifted position. According to the present invention, the protruding distance in the horizontal direction between the tilting point T defined as point of contact of the front wheels 301 on the ground and the equipment connector is decreased in particular in the intermediate position compared to the known arrangement in which the equipment connector 5 follows a circular path.

Based on the inventive lifting arrangement, the load capacity of the construction machine 1 can be increased due to the fact that the tilting moment in the intermediate position of the equipment connector to the construction machine is decreased. On the other hand, the construction machine can be downsized while maintaining the same load capacity by using the inventive concept discussed above.

The path P shown in the drawings is only an example in order to illustrate that the path P deviates from a circular path which is achieved by prior art lifting arrangements. Depending on the detailed setting of the linking mechanism, i.e. the setup of distances and length of the links, the shape of the path P can be influenced appropriately. In context of the present invention, the path P can be considered as vertical path as it deviates from the circular path. It is crucial for the present invention that the path P remains within a predetermined range of a distance between the tilting point T defined by the point of contact of the front wheels 301 with the ground and the vertical distance to the path P.

A further advantage of the above discussed lifting arrangement shown in FIGS. 1-3 is that the structure is based on mechanical components only and a single actuator is sufficient for providing the vertical lift operation. That is, no further actuator for providing the vertical lift is required and a complex control system is not needed.

In addition, due to the specific arrangement of the main arm support means 6 and the guiding means 7 which interact with the main arm 3 in the above explained manner, a very compact arrangement is achievable which does not require the provision of elements of the lifting arrangement at the rear section of the construction machine. As such, this simple lifting arrangement is well applicable to wheel loaders using an articulating steering system which provide only a limited space at the front frame portion for mounting the lifting arrangement.

Second Example

Figure 4:
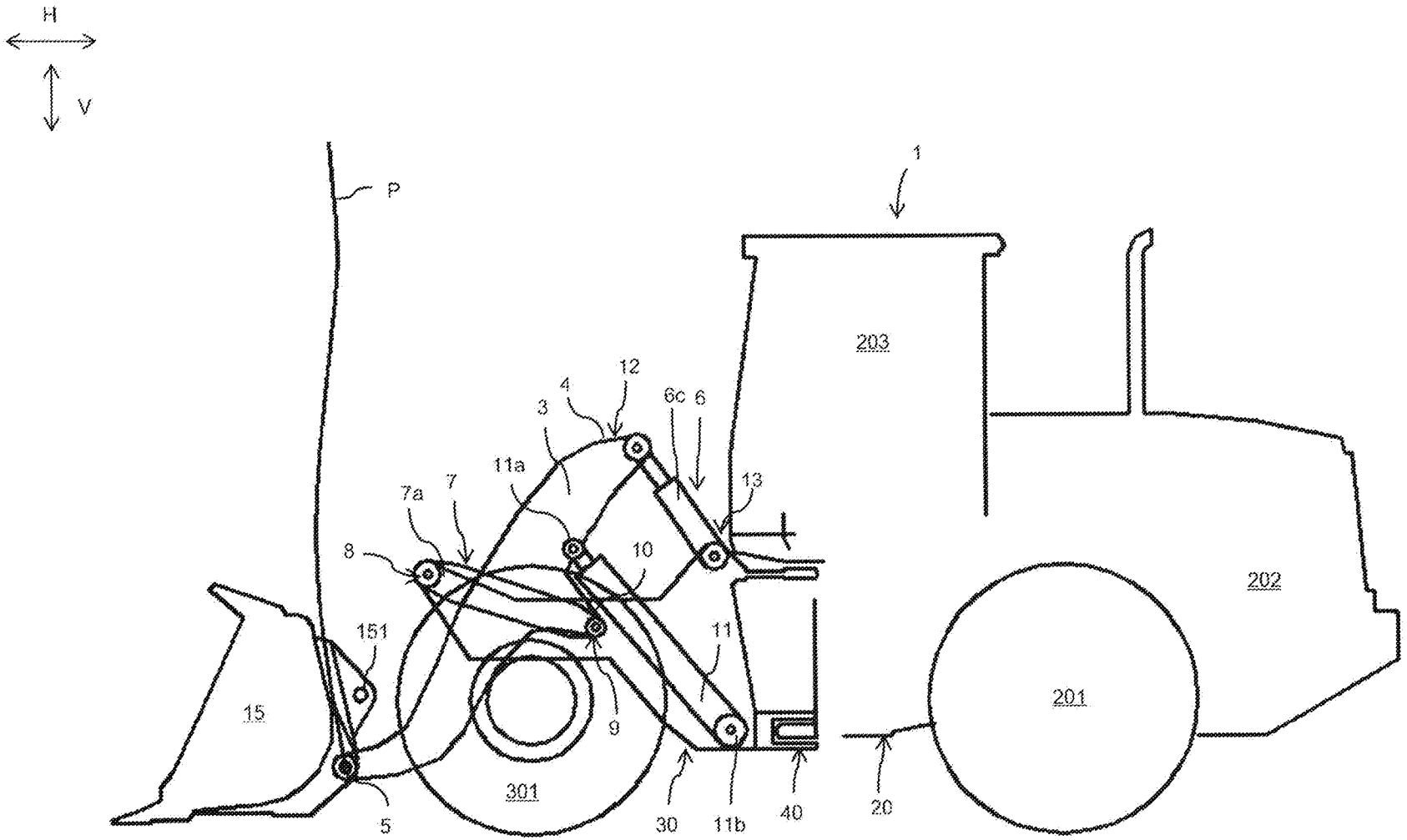
FIG. 4 illustrates a construction machine equipped with a lifting arrangement according to a second example in a lowered position.
Figure 5:
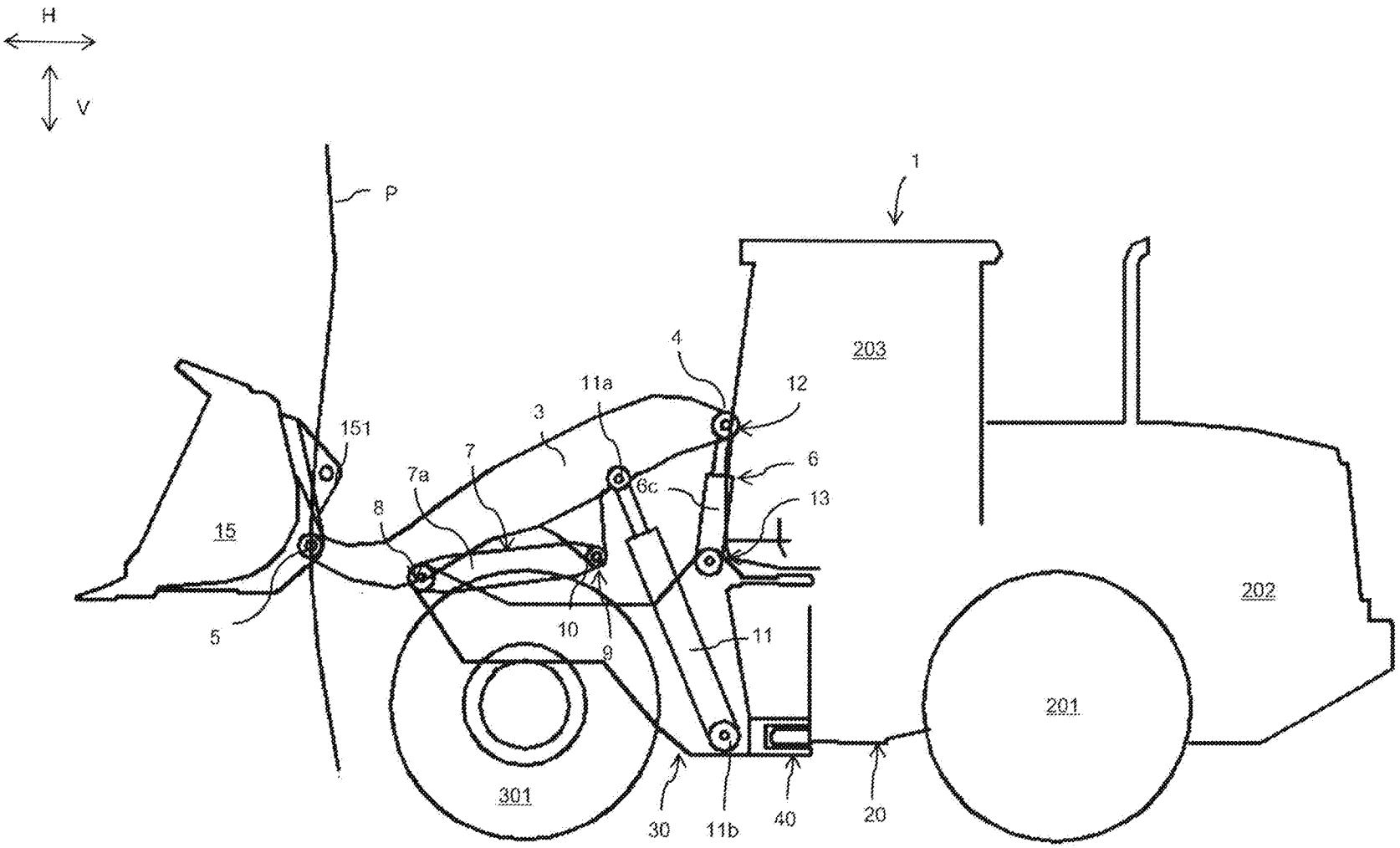
FIG. 5 illustrates a construction machine equipped with the lifting arrangement according to the second example in an intermediate position.
Figure 6:
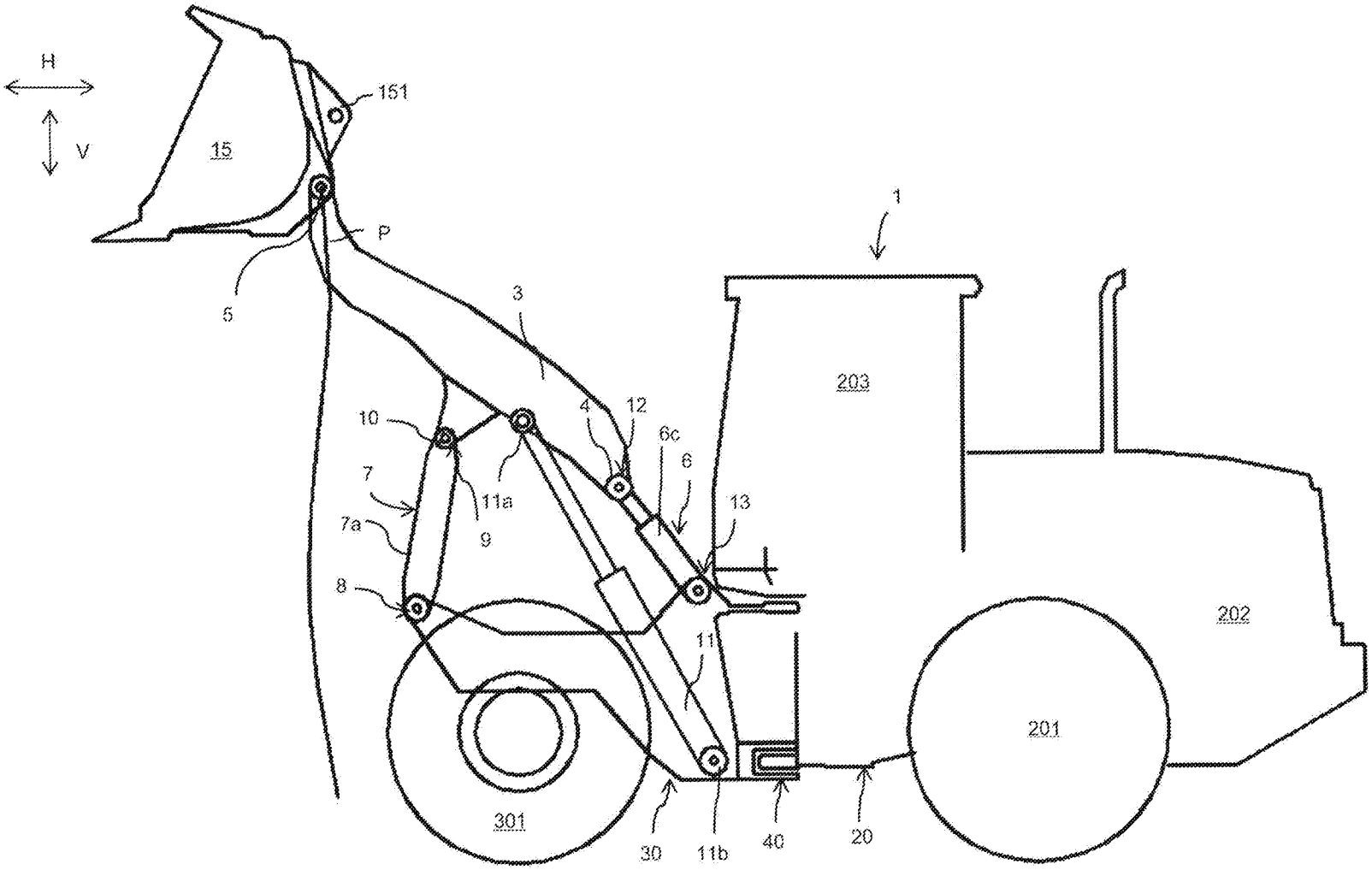
FIG. 6 illustrates a construction machine equipped with the lifting arrangement according to the second example in a lifted position.

A second example of the present invention is explained based on FIGS. 4-6. In the following, only differences between the first example and the present second example will be addressed. All remaining structures are basically the same as explained for the first example.

The lifting arrangement according to the second example in the lowered position is shown in FIG. 4. While in the first example the main arm support means 6 includes the main arm support link 6*a*, the main arm support means 6 according to the second example includes a main arm support actuator 6*c*. The actuator 6*c* has a first end 12 and a second end 13. The first end 12 of the actuator is pivotably connected to the pivot connector 4 of the main arm 3. The second end 13 is pivotably connected to the front frame portion 30.

The main arm support actuator 6*c* is arranged for changing the distance between the first end 12 and the second end 13 by extending or retracting operations. The basic function of the main arm support actuator 6*c* is the same as explained with respect to the first example. However, as additional function, the distance between the first end 12 and the second end 13 of the main arm support actuator 6*c* can be changed in order to adapt the kinematic pattern along which the main arm 3 of the lifting arrangement moves upon actuating the main actuator 11. For example, it is possible to adapt the extension distance between the first end 12 and the second end 13 of the main arm support actuator 6*c* in the course of the lifting operation of the lifting arrangement. Moreover, it is possible to set the extension position of the main arm support actuator 6*c* to a first length in the lowered position shown in FIG. 4. In the course of the lifting operation of the lifting arrangement, the extension length of the main arm support actuator 6*c* can be set to a second length, being shorter than the first length, upon reaching the intermediate position shown in FIG. 5. In the course of further lifting the lifting arrangement, the extension length of the main arm support actuator 6*c* can be reset to the first length upon reaching the lifted position shown in FIG. 6. This is only an example and the specific details of setting the length of the main arm support actuator 6*c* can be adapted as needed.

It is possible to operate the main arm support actuator 6*c* with a manual operation by the operator of the construction machine 1. However, it is also possible to include a control system based on position sensors for sensing the position of specific elements of the lifting arrangement in order to automatically set the extension length of the main arm support actuator 6*c* for optimizing the shape of the path P which the equipment connector 5 follows upon a lifting operation. As further advantage, it is possible to increase the extension length of the main arm support actuator 6*c* at the maximum lift position in order to shift the main arm 3 in a forward direction with respect to the construction machine 1 e.g. for reaching beyond walls of containers for dumping load to be unloaded from the bucket 15.

It is noted that the additional arrangement of the actuator function of the main arm support means 6 provides the same advantages as explained above. Also, this arrangement is not strictly required for achieving the above object and advantages.

Third Example

Figure 7:
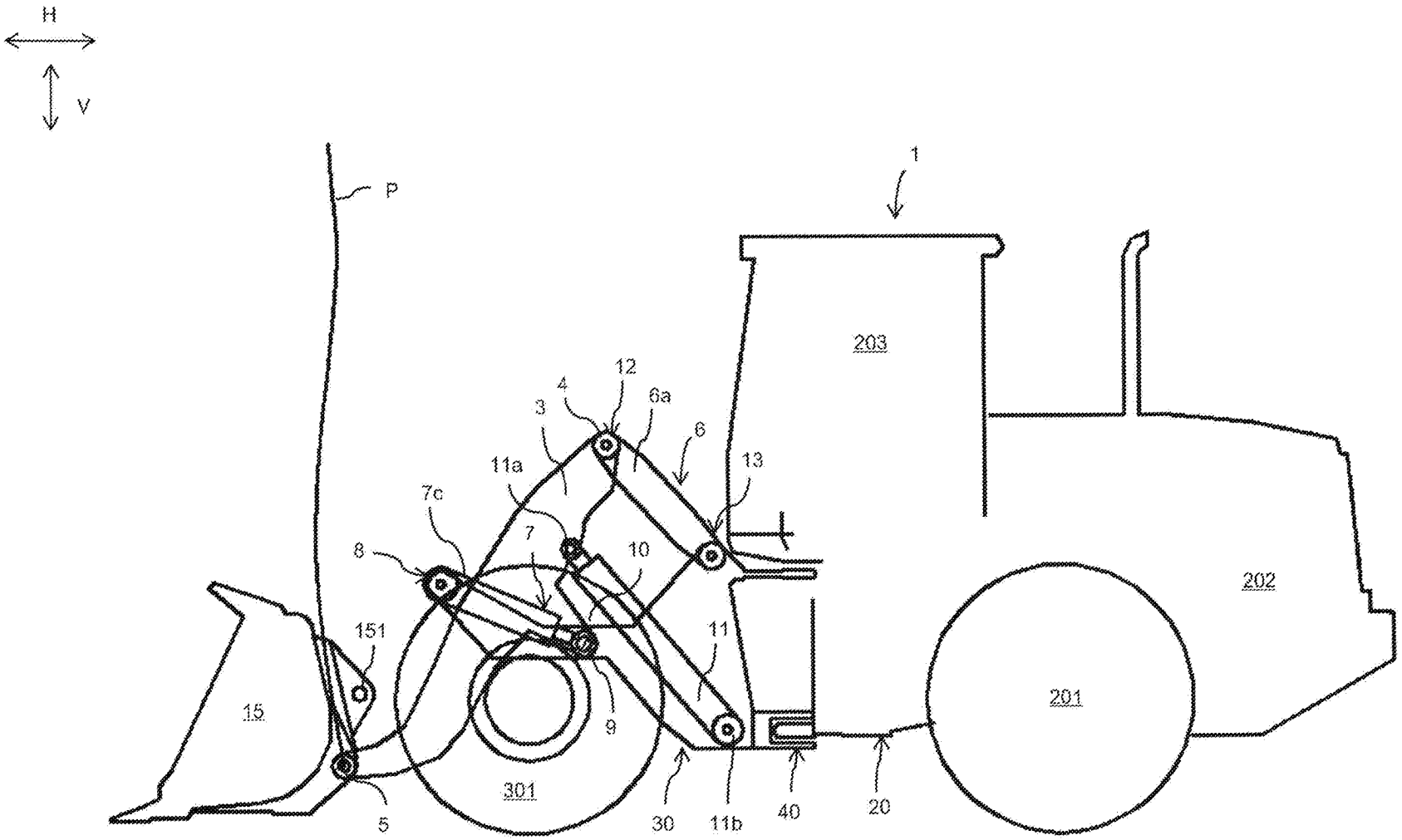
FIG. 7 illustrates a construction machine equipped with a lifting arrangement according to a third example in a lowered position.
Figure 8:
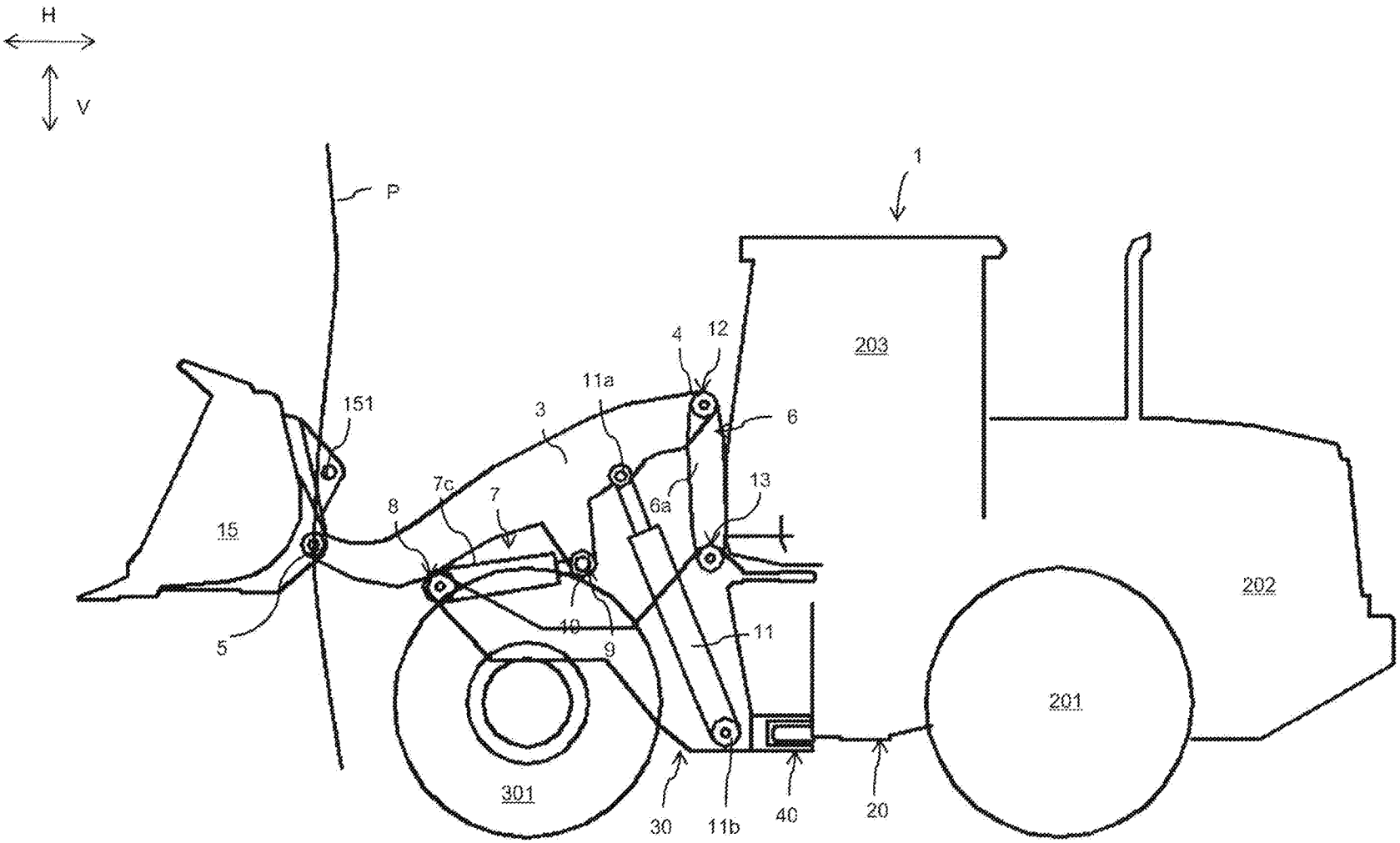
FIG. 8 illustrates a construction machine equipped with the lifting arrangement according to the third example in an intermediate position.
Figure 9:
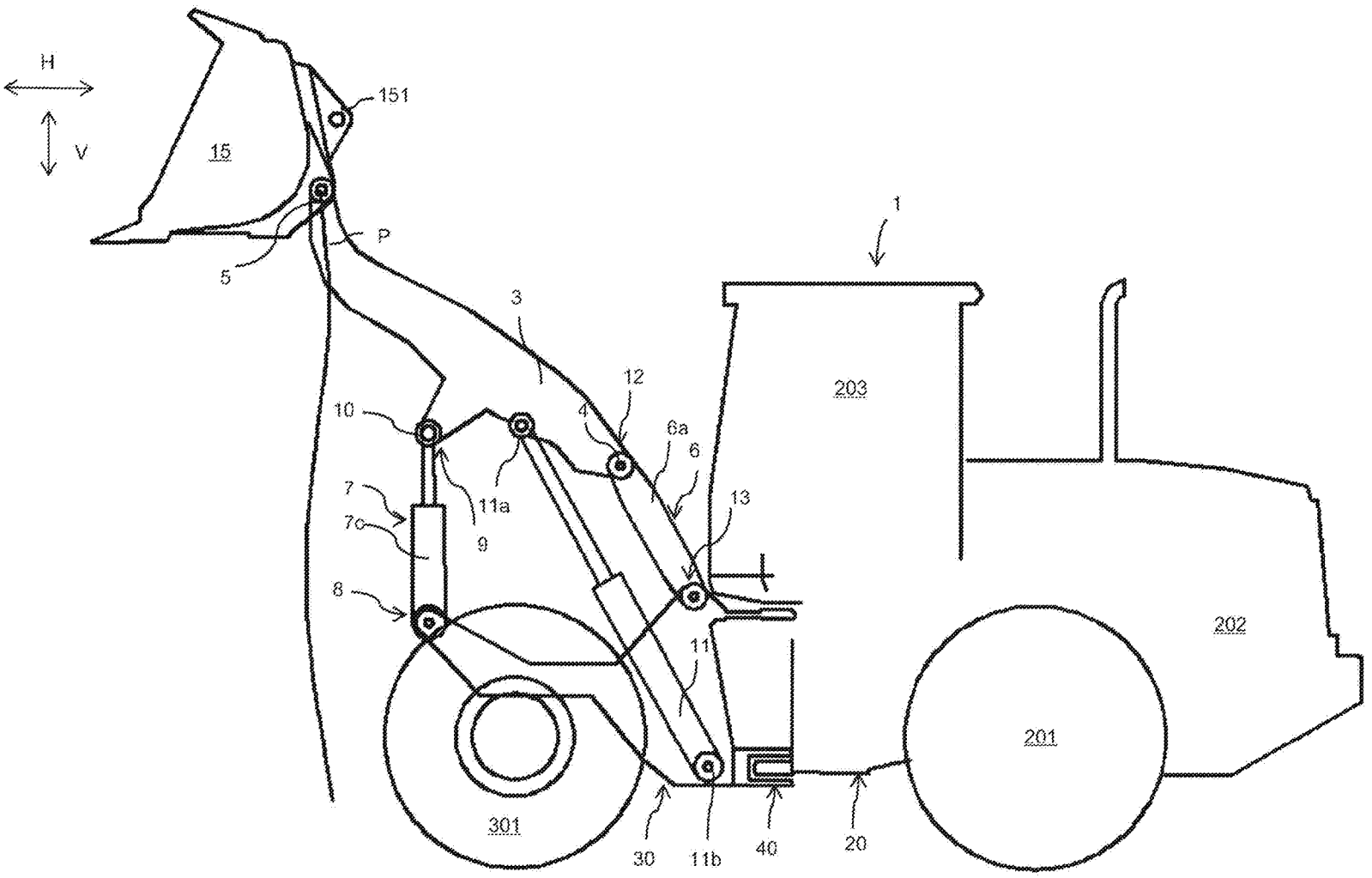
FIG. 9 illustrates a construction machine equipped with the lifting arrangement according to the third example in a lifted position.

A third example of the present invention is explained based on FIGS. 7-9. In the following, only differences between the first example and the present third example will be addressed. All remaining structures are basically the same as explained for the first example.

In the first example, the guiding means 7 includes the guiding arm 7*a*. In contrast, the present third example is arranged with a guiding means 7 which includes a guiding actuator 7*c* as shown in FIG. 7. The guiding actuator 7*c* according to the third example includes a first end 8 and a second end 9, wherein the first end 8 is pivotably mounted to the front frame portion 30 and the second end 9 is pivotably mounted to the main arm 3 at the guided portion 10. The guiding actuator 7*c* is embodied as linear actuator with an adjustable extension length between the first end 8 and the second end 9. The actuator is preferably embodied as hydraulic actuator which can be operated for extending or retracting. FIG. 7 shows the lifting arrangement according to the third example in the lowered position. Upon lifting the lifting arrangement from the lowered position to the intermediate position shown in FIG. 8, the guided portion of the main arm is guided along a specific path determined by the guiding means 7. In the present case, the guiding means 7 includes the guiding actuator 7*c* having an adjustable extension length. Accordingly, the path along which the guided portion 10 of the main arm 3 is guided can be adjusted.

In the illustration in FIG. 8, the extension length is decreased in the intermediate position of the lifting arrangement with respect to the lowered position thereof shown in FIG. 7. Moreover, the extension length of the guiding actuator 7*c* can be extended with respect to the lowered position upon approaching the lifted position as shown in FIG. 9. Accordingly, the movement pattern of the equipment connector can be adapted appropriately such that the optimum path P is achievable. In addition, it is possible to increase the total lifting height of the lifting arrangement by employing the additional feature of said guiding actuator 7*c* which enables an increase of the maximum lifting height of the lifting arrangement. It is noted that the guiding actuator 7*c* can be operated manually by the operator or automatically by using a control system having sensors for determining the position of elements of the lifting arrangement.

It is noted that the additional arrangement of the actuator function of the guiding means 7 provides the same advantages as explained above. Also, this arrangement is not strictly required for achieving the above object and advantages. It is also noted that the third example can be combined with the second example in order to provide the additional advantages of both alternatives which can be realized in the lifting arrangement.

Fourth Example

Figure 10:
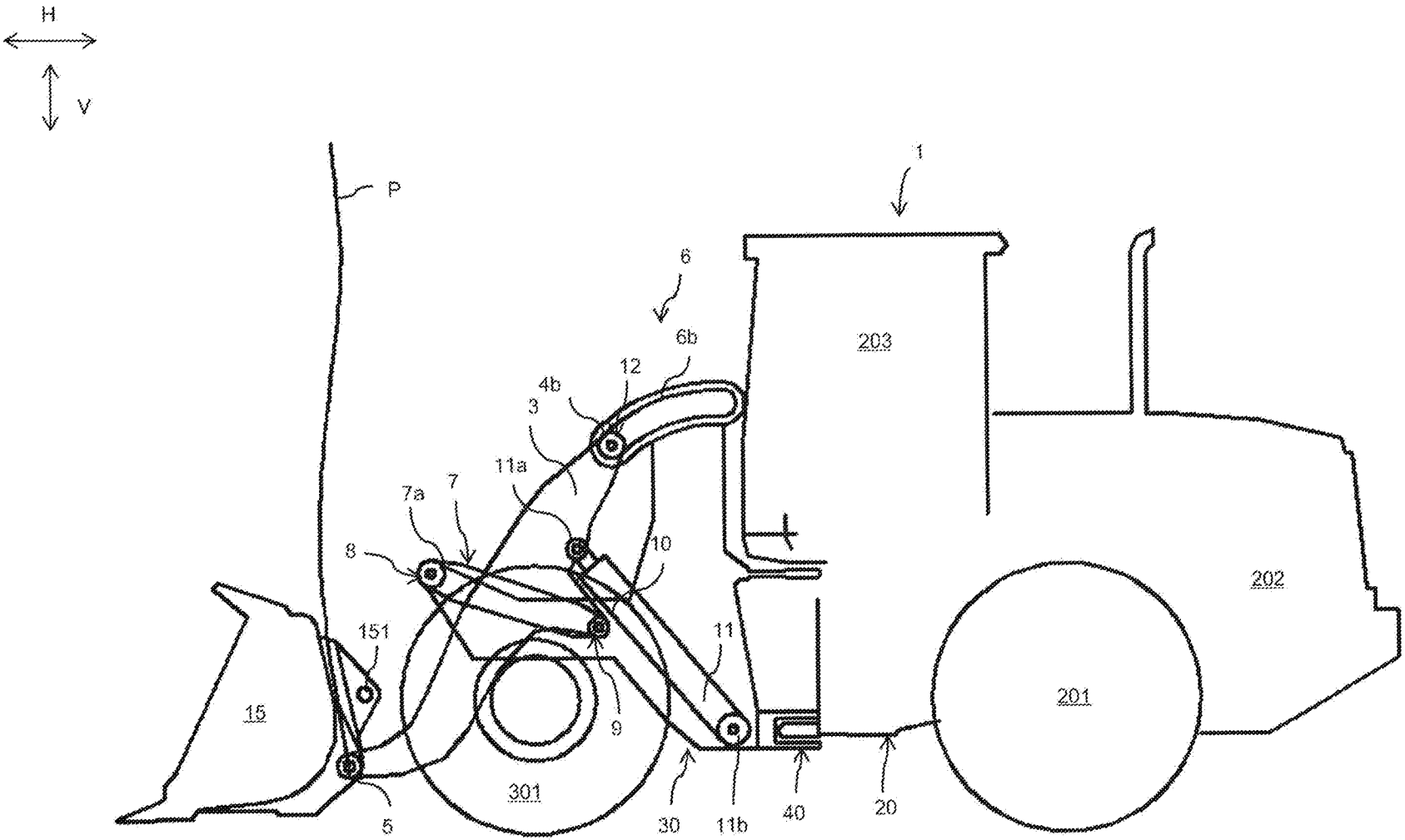
FIG. 10 illustrates a construction machine equipped with a lifting arrangement according to a fourth example in a lowered position.
Figure 11:
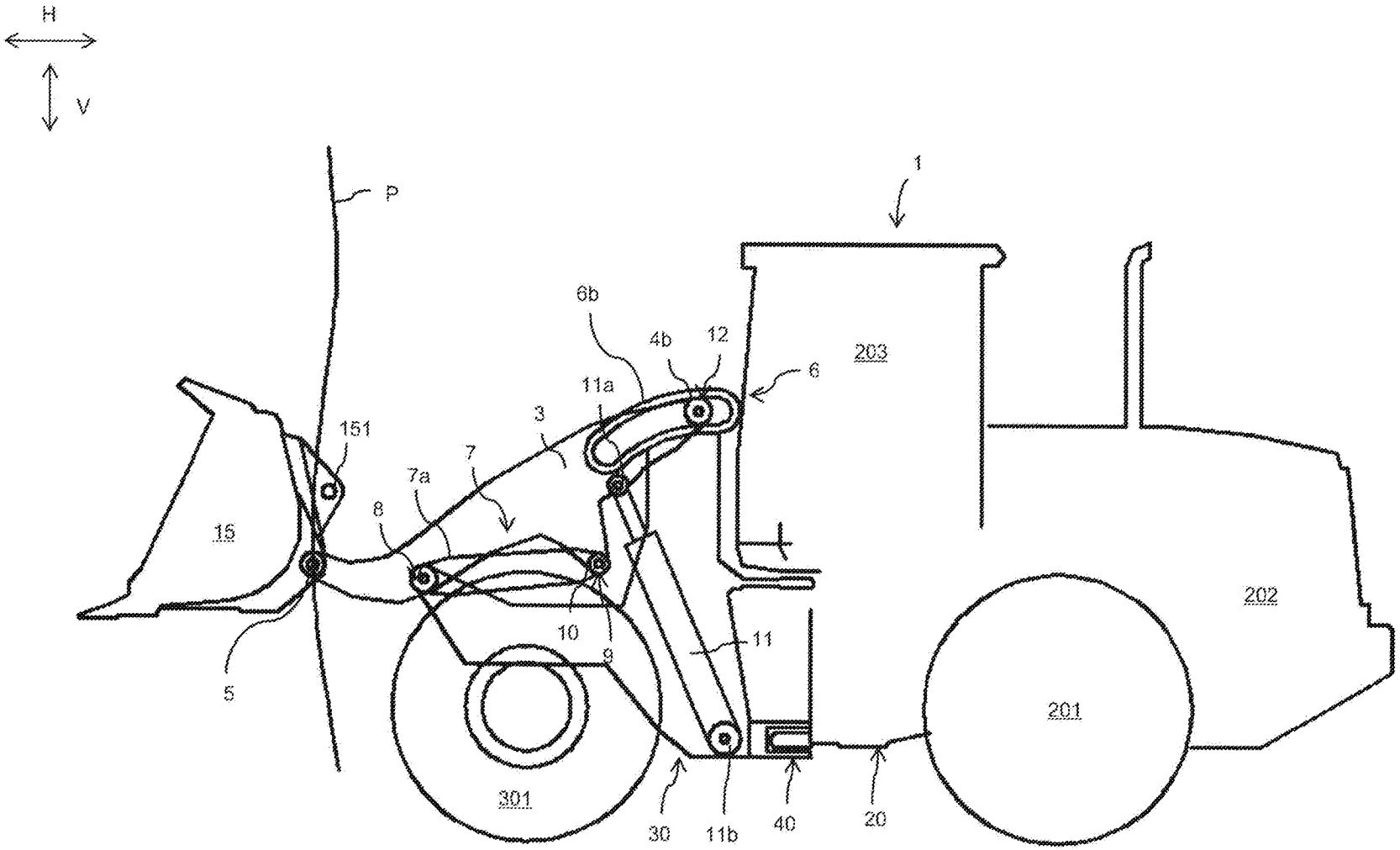
FIG. 11 illustrates a construction machine equipped with the lifting arrangement according to the fourth example in an intermediate position.
Figure 12:
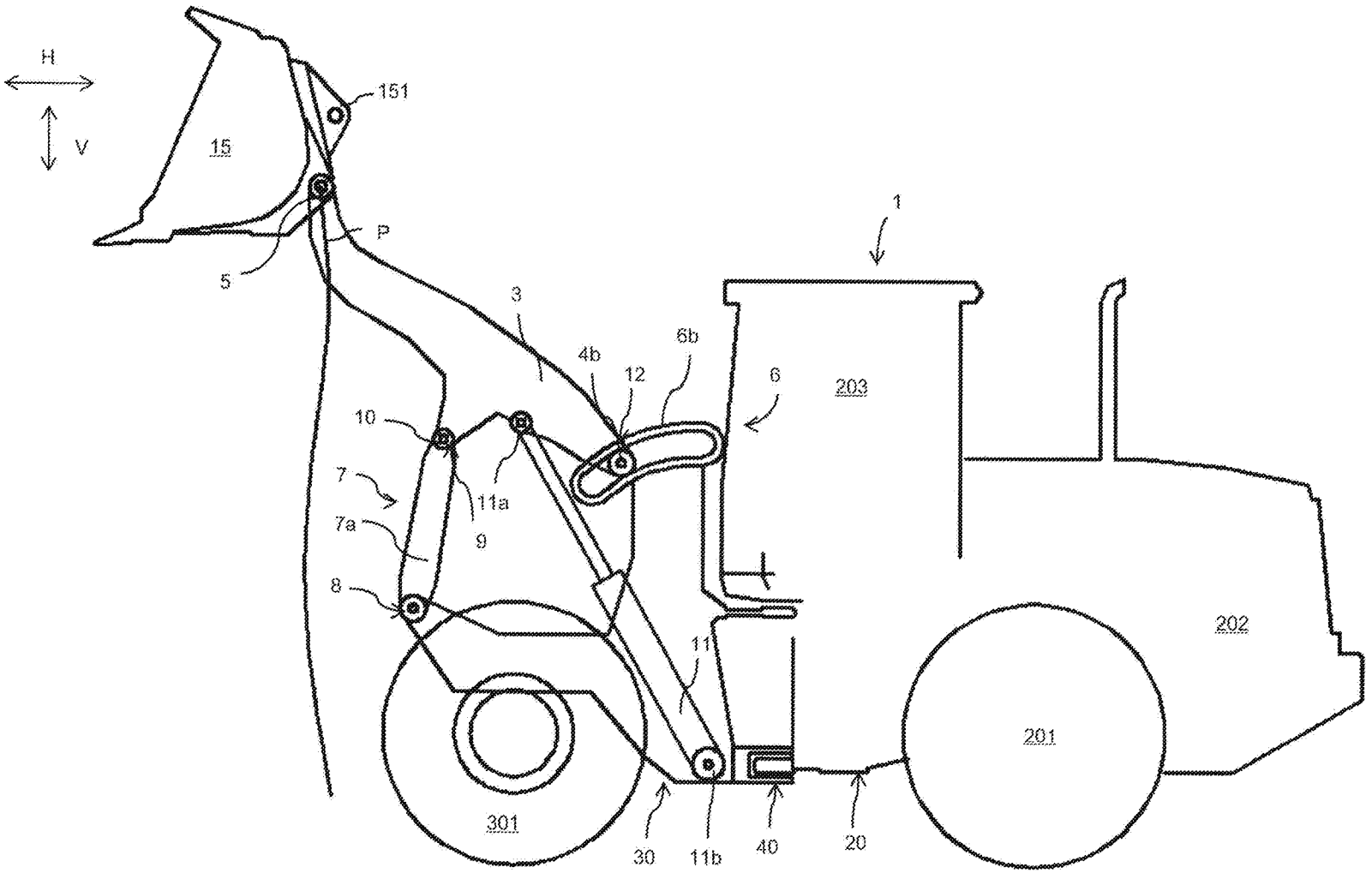
FIG. 12 illustrates a construction machine equipped with the lifting arrangement according to the fourth example in a lifted position.

A fourth example of the present invention is explained based on FIGS. 10-12. In the following, only differences between the first example and the present fourth example will be addressed. All remaining structures are basically the same as explained for the first example.

While the previous examples employed a main arm support means 6 which includes main arm support link 6*a* the present fourth example employs a sliding element 6*b* in the main arm support means 6. As shown in FIG. 10, a sliding element 6*b* is provided in the form of one or multiple guiding rails having a predetermined shape. In the present example, the shape is a sector of a circle for providing a movement path of the pivot connector 4 of the main arm along a circular path. The pivot connector 4*b* of the main arm in the present example is slightly modified in order to provide a sliding function in or on said sliding element 6*b*. Optional, a sliding piece or a roller arrangement can be used for providing the relative movement between the pivot connector 4*b* and the sliding element 6*b*.

The lifting operation of the present fourth example is similar as the lifting operation of the first example. The intermediate position of the lifting arrangement according to the fourth example as shown in FIG. 11, while the lifted position of the lifting arrangement according to the fourth example is shown in FIG. 12. With the structure according to the present example, the increase in loading capacity or enhancing the total efficiency as in the first example are achieved. In addition, it is possible with the present fourth example to provide the sliding element 6*b* with a predetermined shape or curve in order to optimize the movement pattern of the equipment connector 5 upon the lifting operation of the lifting arrangement. In particular, it is possible in modification to provide the sliding element 6*b* with straight rails which are substantially arranged along the longitudinal direction of the construction machine.

It is noted that the additional arrangement of the sliding element 6*b* provides the same advantages as explained above. Also, this arrangement is not strictly required for achieving the above object and advantages. It is also noted that the fourth example can be combined with the third example in order to provide the additional advantages of both alternatives which can be realized in the lifting arrangement.

Fifth Example

Figure 13:
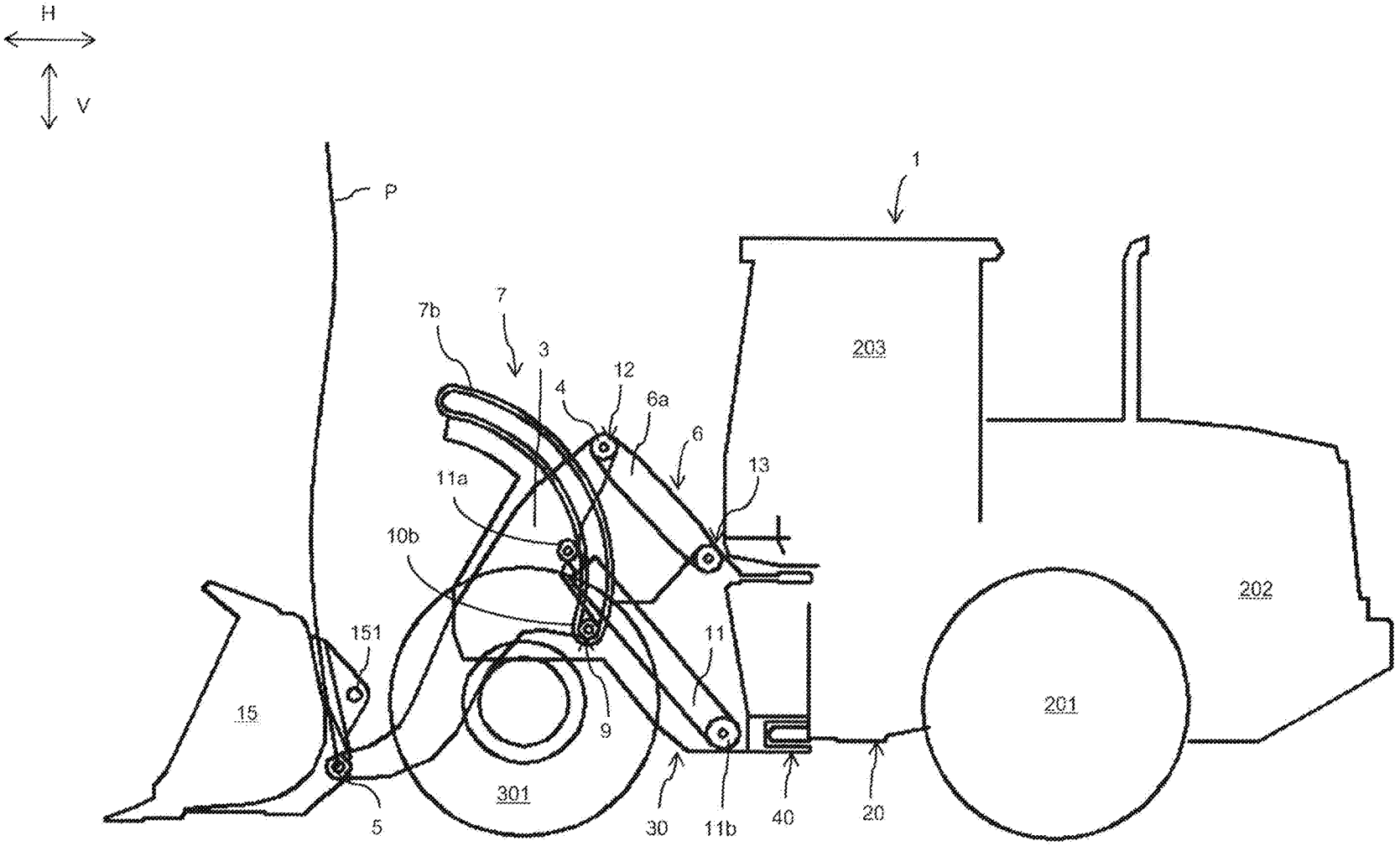
FIG. 13 illustrates a construction machine equipped with a lifting arrangement according to a fifth example in a lowered position.
Figure 14:
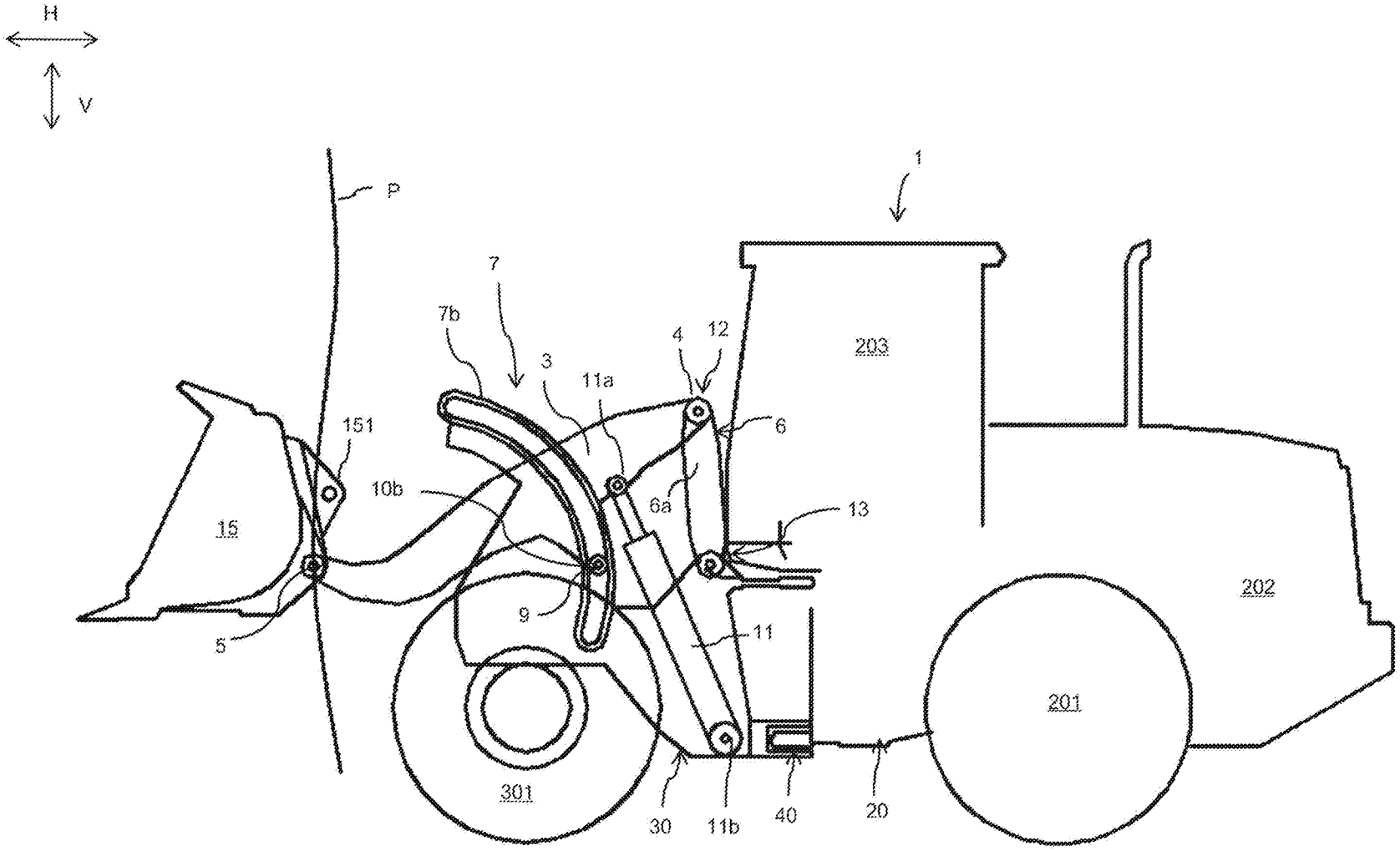
FIG. 14 illustrates a construction machine equipped with the lifting arrangement according to the fifth example in an intermediate position.
Figure 15:
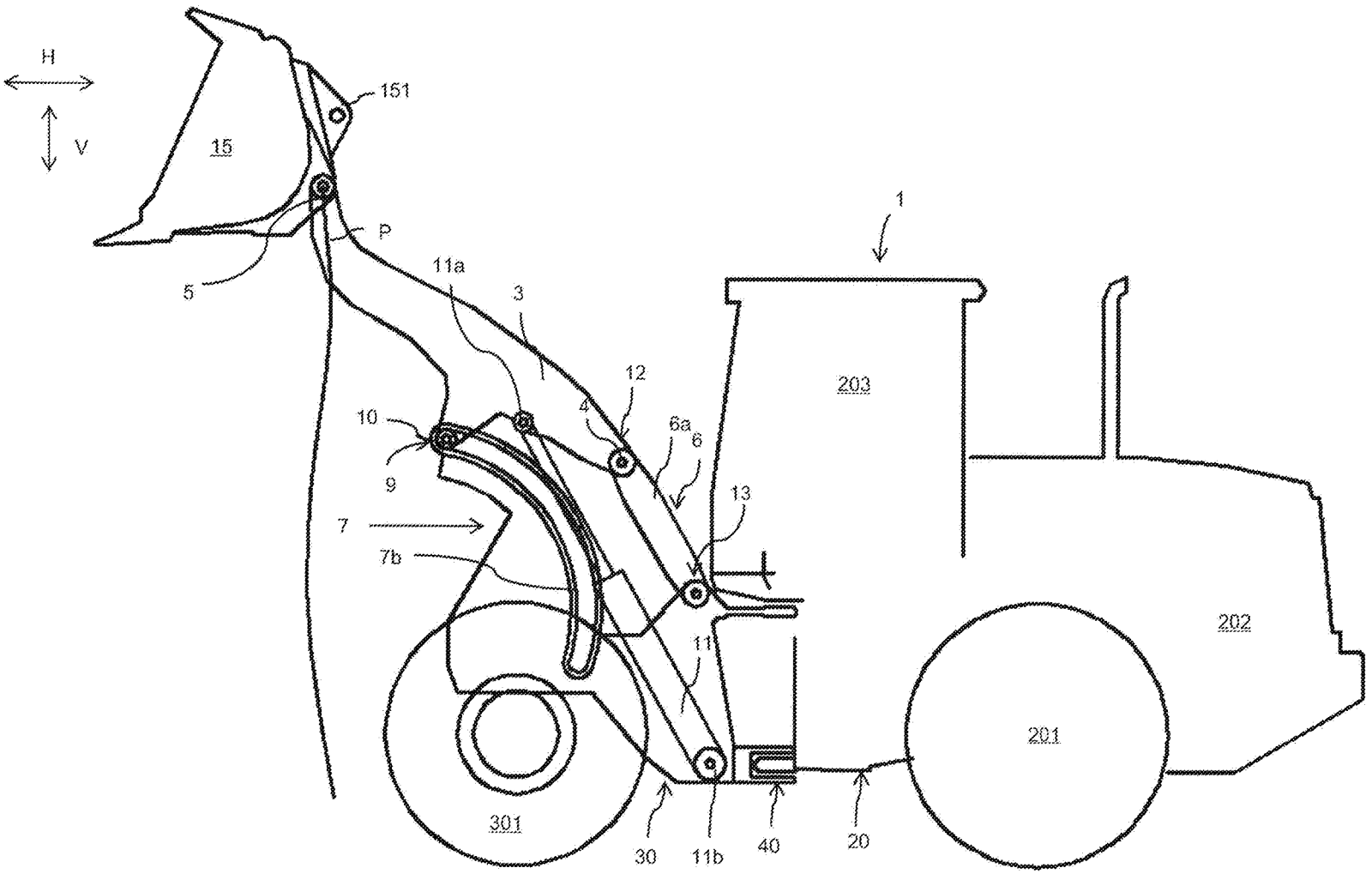
FIG. 15 illustrates a construction machine equipped with the lifting arrangement according to the fifth example in a lifted position.

A fifth example of the present invention is explained based on FIGS. 13-15. In the following, only differences between the first example and the present fifth example will be addressed. All remaining structures are basically the same as explained for the first example.

While in the first example, the guiding means 7 includes the guiding arm 7*a*, the guiding means 7 in the present fifth example includes a guiding rail 7*b* which is mounted stationary with respect to the front frame portion 30. The guiding rail 7*b* in the example shown in FIG. 13 is formed as sector of a circle. The guiding rail 7*b* is provided for guiding the guided portion 10 of the main arm 3. The guiding is achieved e.g. by a sliding piece or a roller arrangement for guiding the guided portion 10 of the main arm 3 along the guiding rail 7*b*. In the example shown in FIG. 13, the shape of the guiding rail is such as the path along which the guided portion 10 is guided is bulged towards the rear side of the construction machine, e.g in the direction of the main arm support means 6.

The operation of the fifth example is similar to the operation of the first example. Starting from the lowered position shown in FIG. 13, the main arm is lifted by actuating the actuator 11 to the intermediate position shown in FIG. 14. Furthermore, the lifted position is achieved which is shown in FIG. 15 upon further actuating the actuator 11. By guiding the guided portion 10 of the main arm 3 along the path which is determined by the shape of the guiding rail 7*b*, the kinematic pattern is achieved which is similar to the kinematic pattern achieved with the first example.

In particular, the same advantages regarding an increase of the loading capacity and the total efficiency of the construction machine are achieved with the fifth example.

Although the guiding rail 7*b* according to the present fifth example is shown as sector of a circle, it is possible to provide a different shape which deviates from the illustrated sector of a circle. In particular, it is possible to adapt the shape in order to optimize the kinematic pattern in view of achieving an optimum path P along which the equipment connector is to follow. As consequence, based on this degree of freedom, the path P can be further optimized by setting the shape of the guiding rail 7*b* according to the fifth example.

It is noted that the additional arrangement of the actuator function of the guiding rail 7*b* provides the same advantages as explained above. Also, this arrangement is not strictly required for achieving the above object and advantages. It is also noted that the third example can be combined with the second or fourth example in order to provide the additional advantages of such alternatives which can be realized in the lifting arrangement.

Further Examples

In the following, modifications of the above mentioned examples of the present invention are discussed based on FIGS. 16-27.

Figure 16:
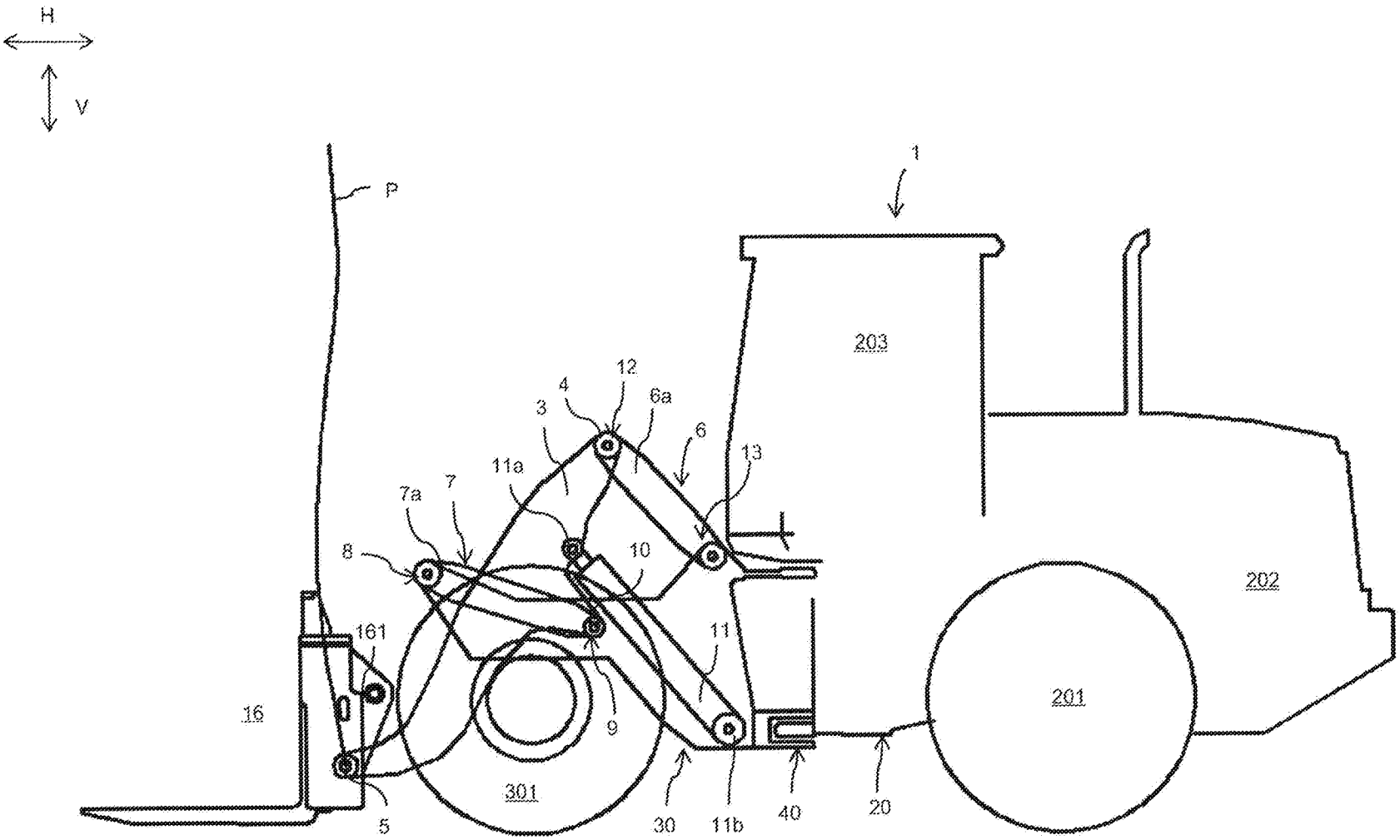
FIGS. 16-18 illustrate a construction machine equipped with a lifting arrangement according to a modification of the first example.
Figure 17:
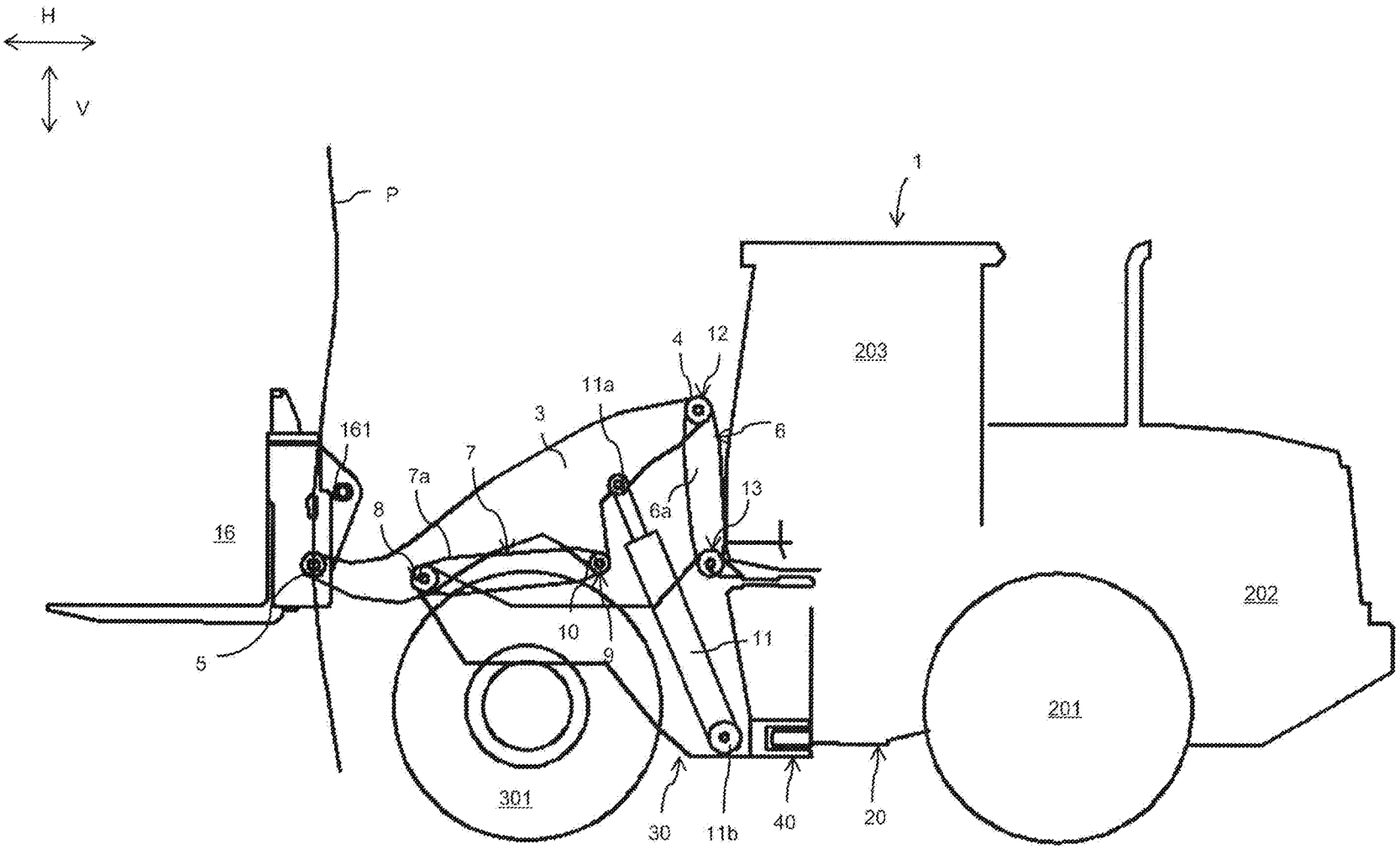
Figure 18:
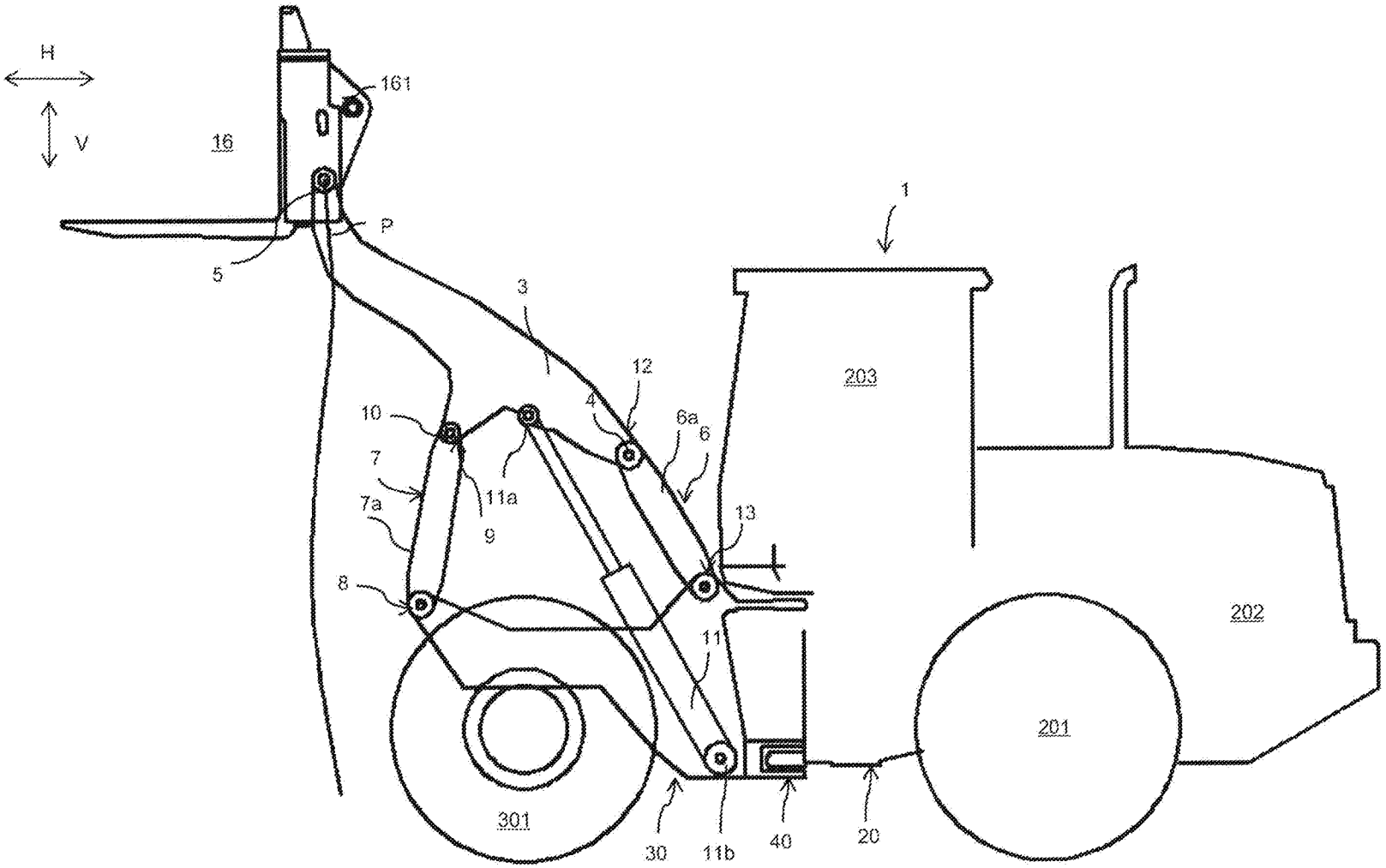
Figure 19:
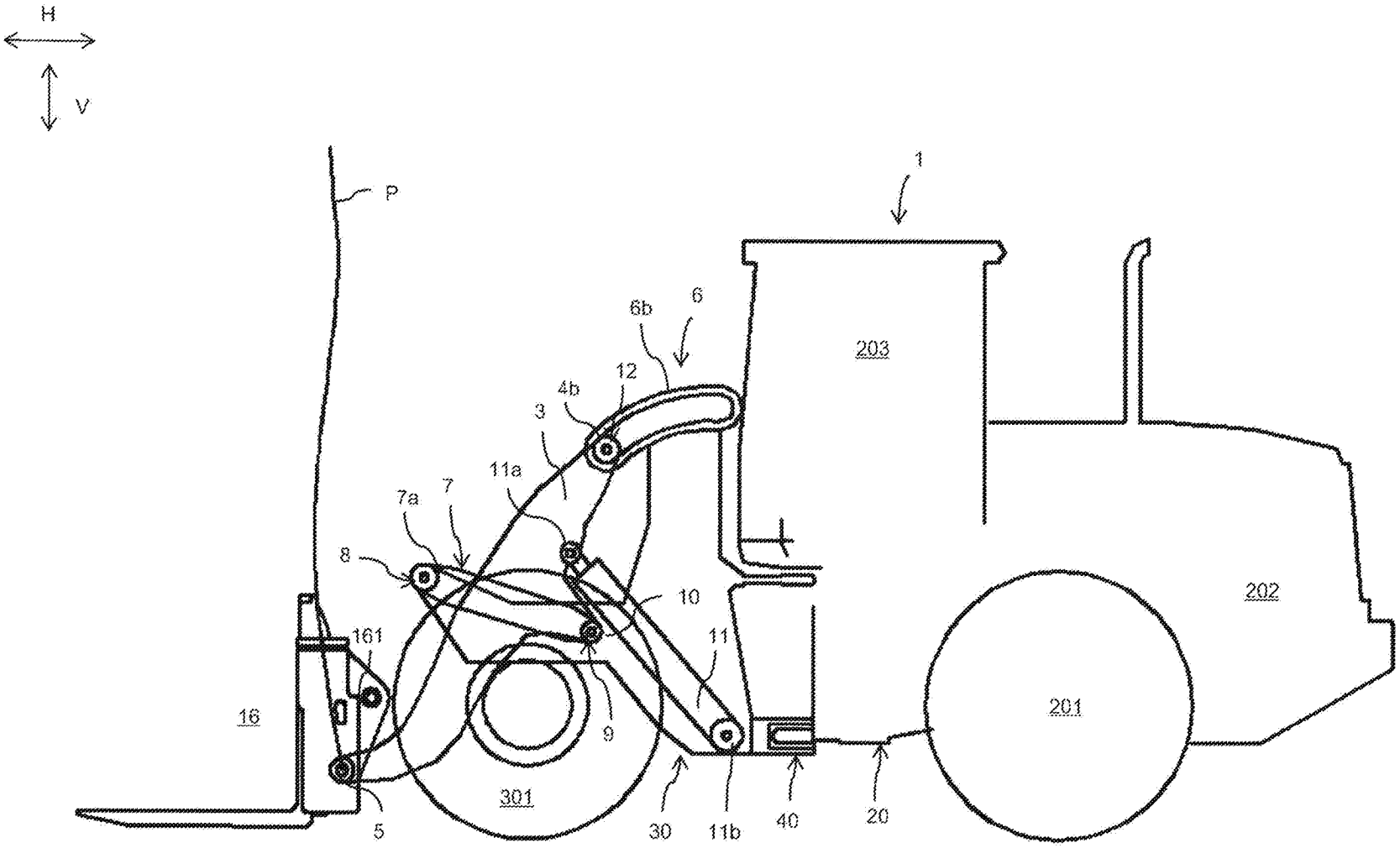
FIGS. 19-21 illustrate a construction machine equipped with a lifting arrangement according to a modification of the fourth example.
Figure 20:
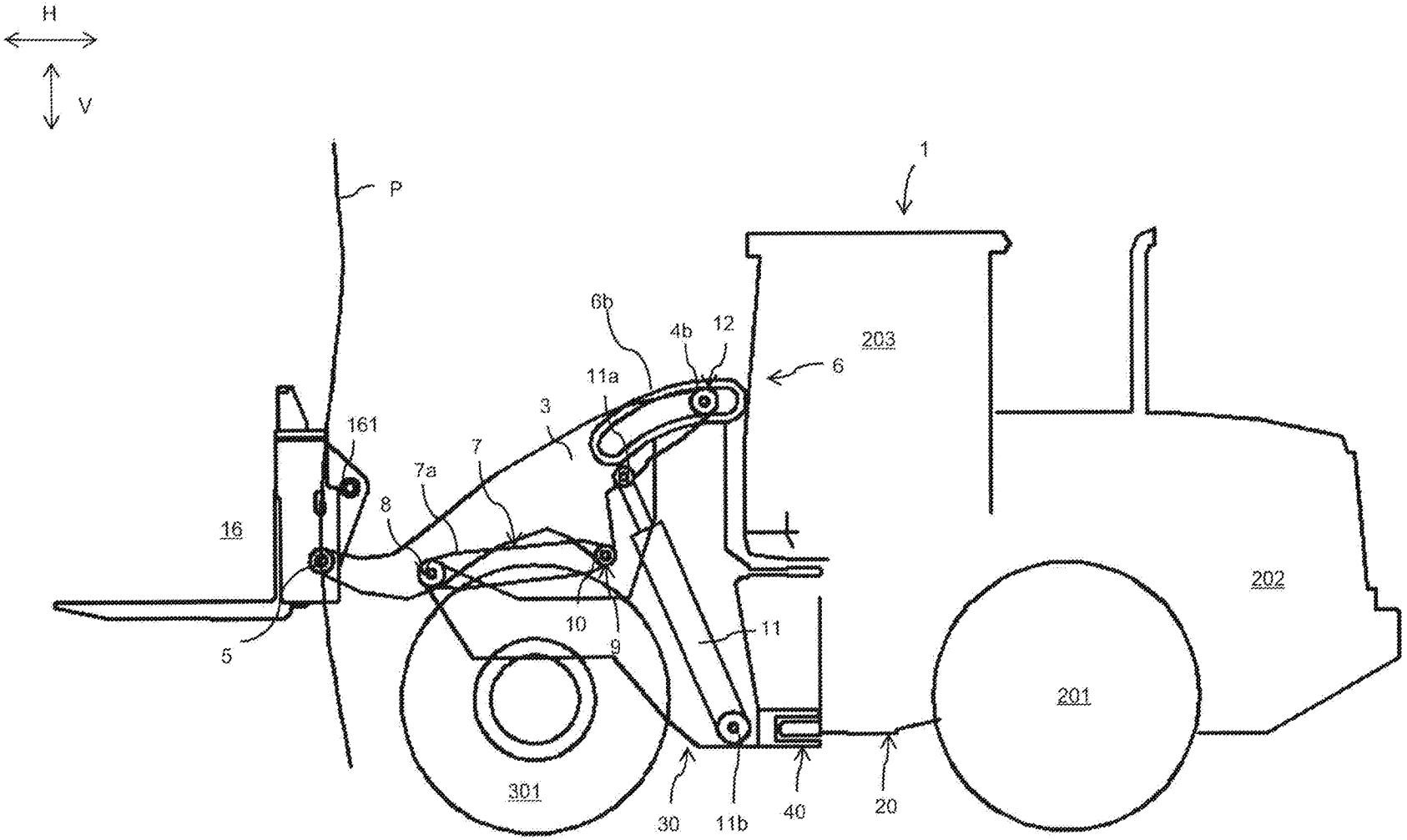
Figure 21:
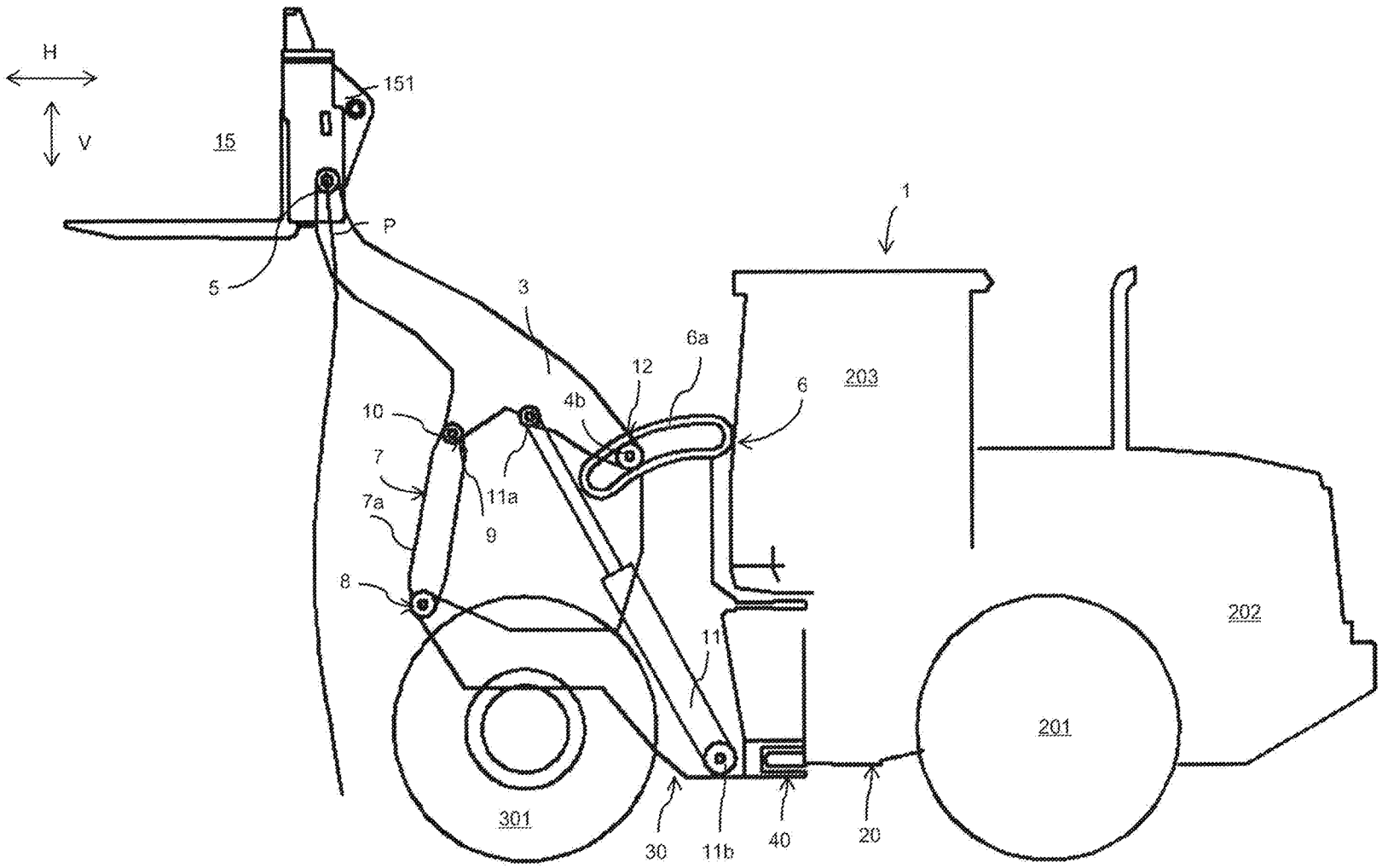
Figure 22:
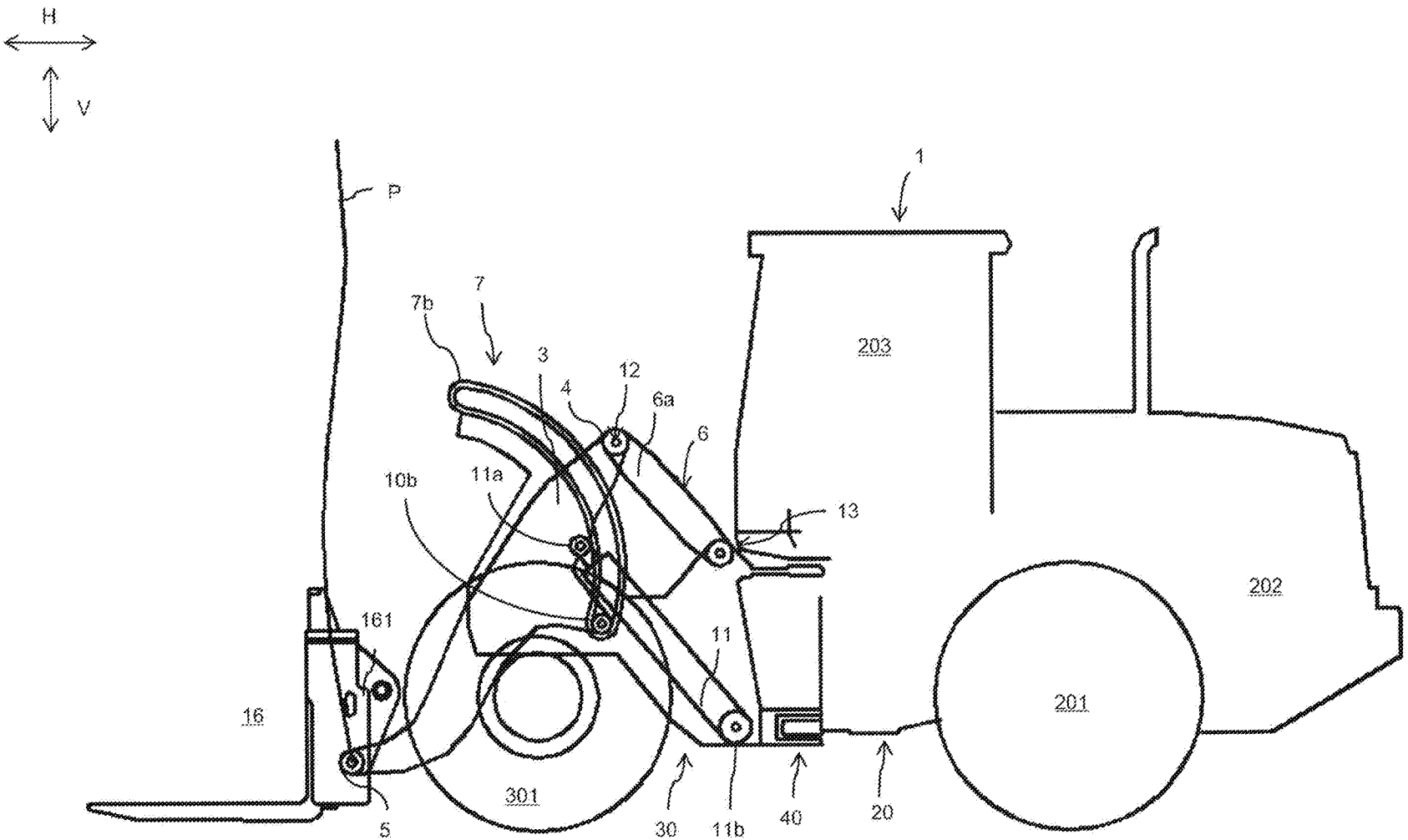
FIGS. 22-24 illustrate a construction machine equipped with a lifting arrangement according to a modification of the fifth example.
Figure 23:
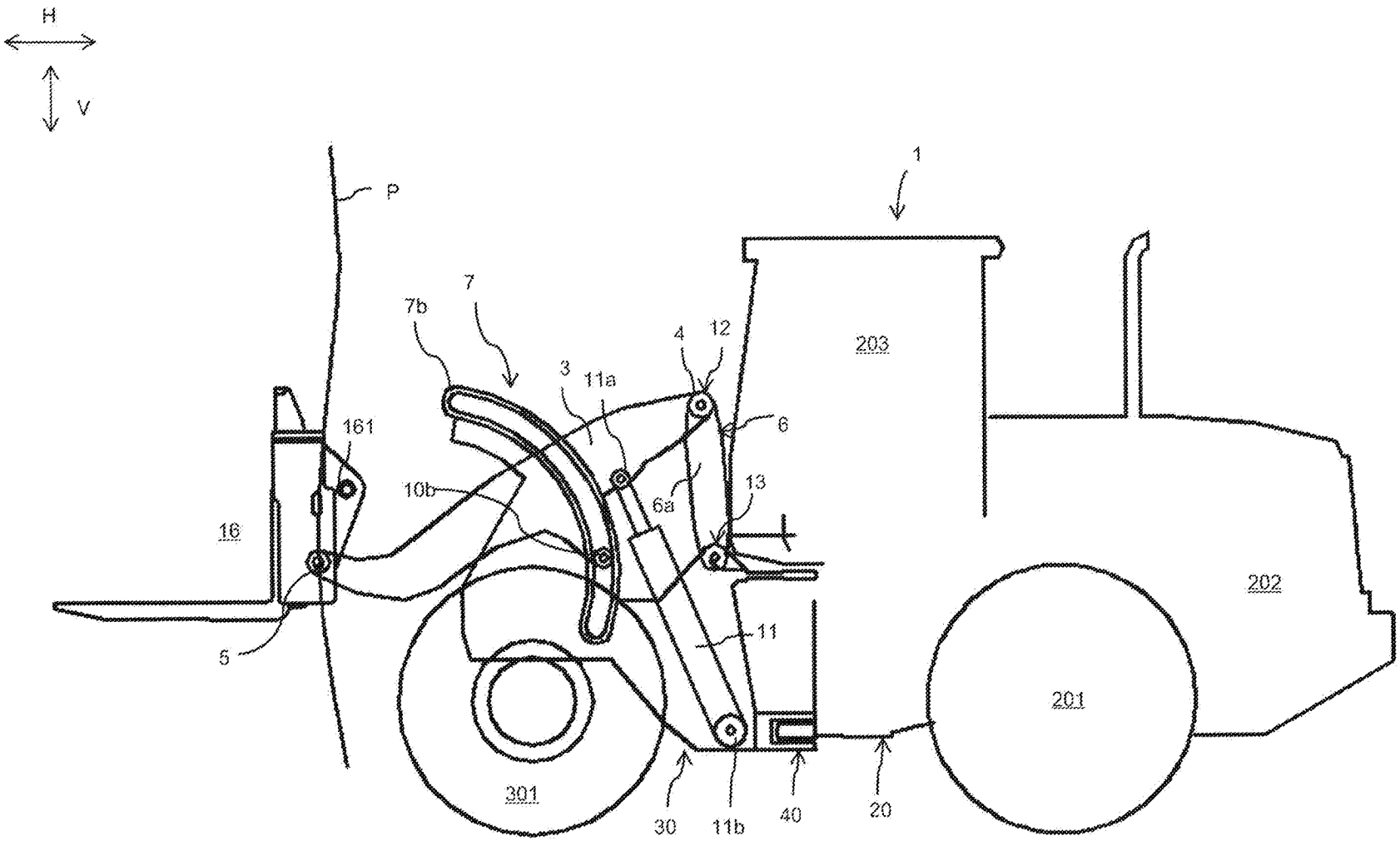
Figure 24:
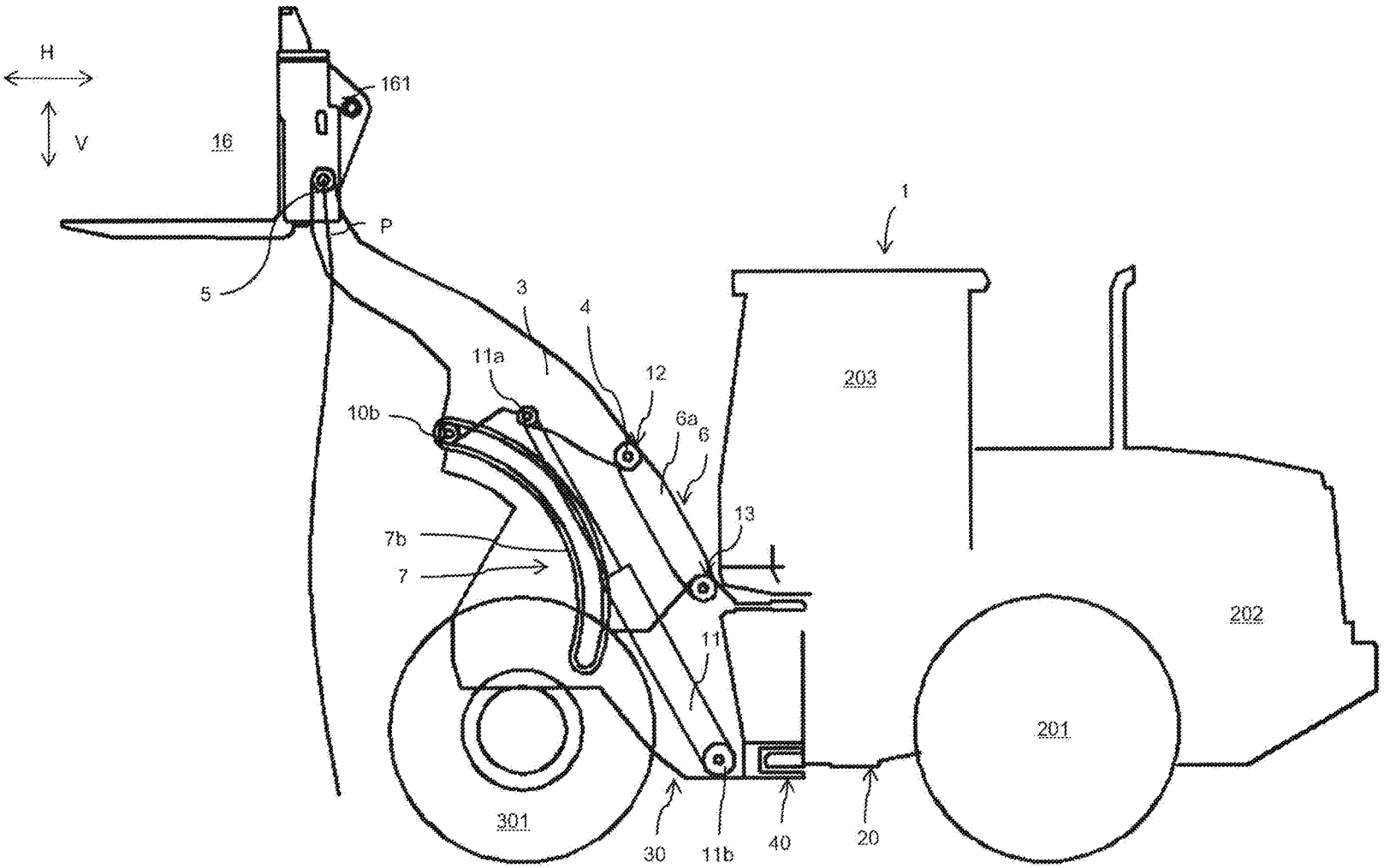

While a bucket 15 as equipment mounted to the equipment connector 5 is shown in the previous examples, it is possible to provide a lifting fork 16 as equipment to be mounted to the equipment connector 5. The above mentioned modification is applicable to all above mentioned examples. In particular, FIGS. 16-18 show this modification applicable to the first example, FIGS. 19-21 show this modification applicable to the fourth example, while FIGS. 22-24 show this modification applicable to the fifth example.

Figure 26:
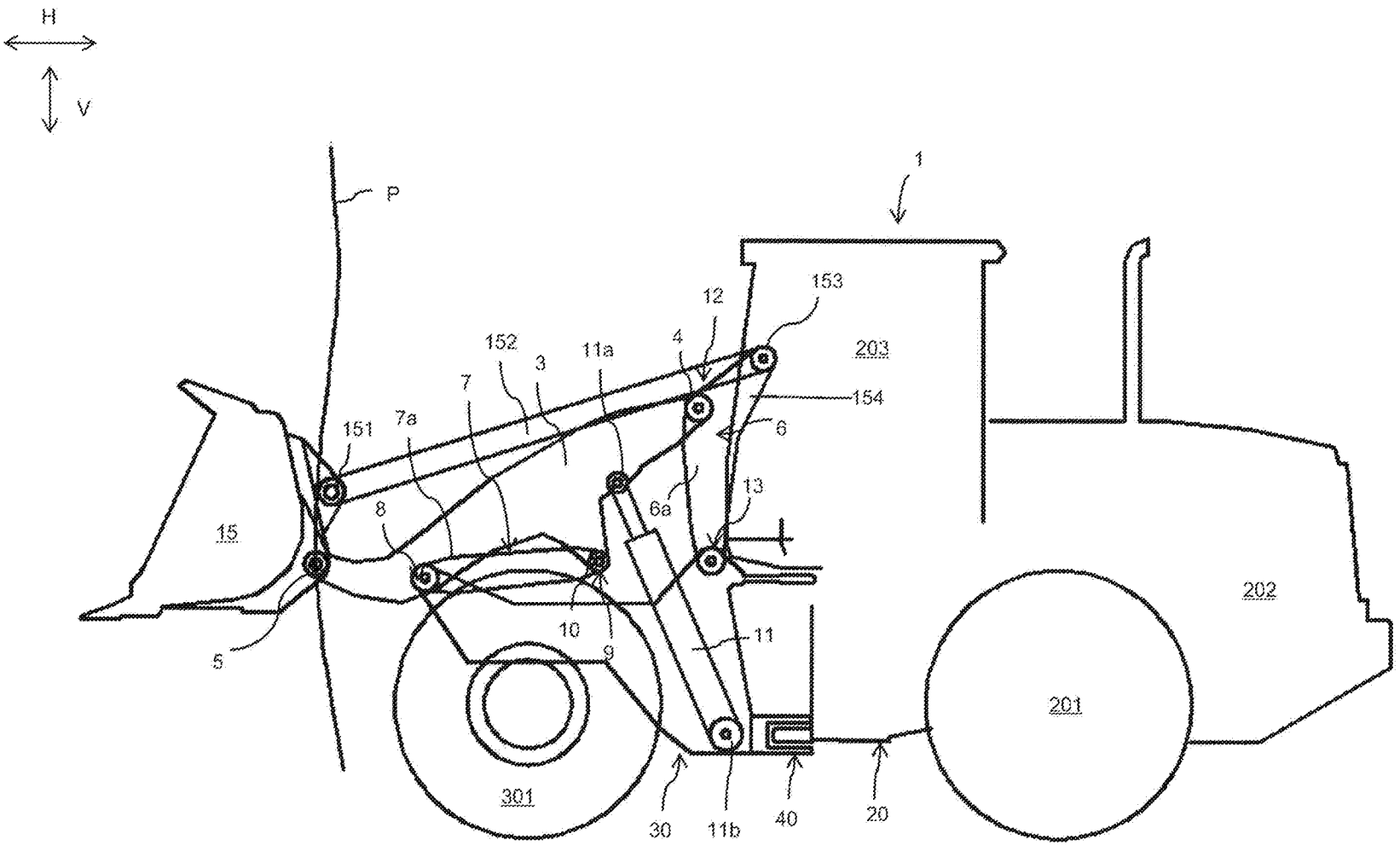
FIG. 26 illustrates a construction machine equipped with the lifting arrangement according to the sixth example in an intermediate position.
Figure 27:
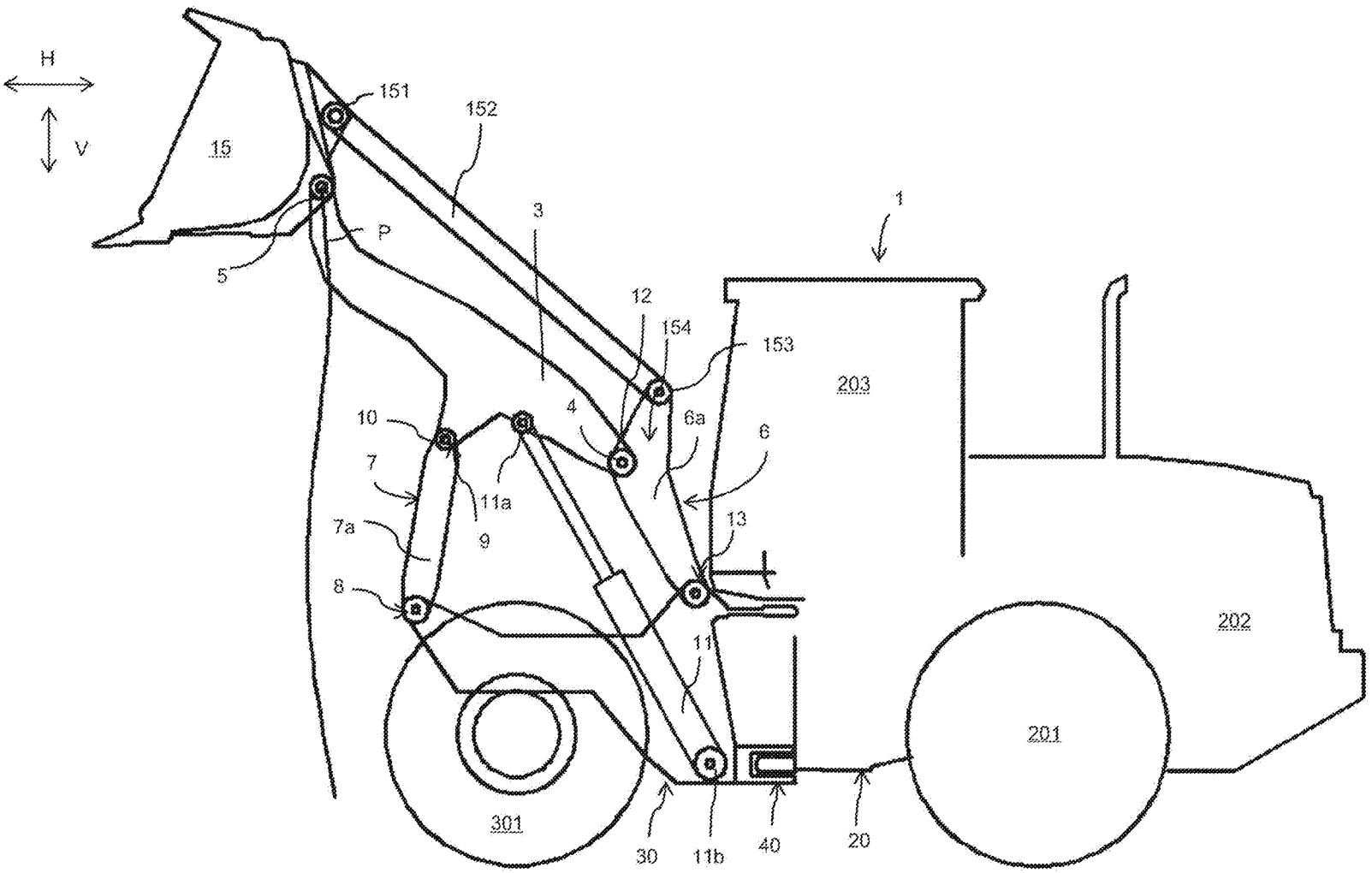
FIG. 27 illustrates a construction machine equipped with the lifting arrangement according to the sixth example in a lifted position.
Figure 28:
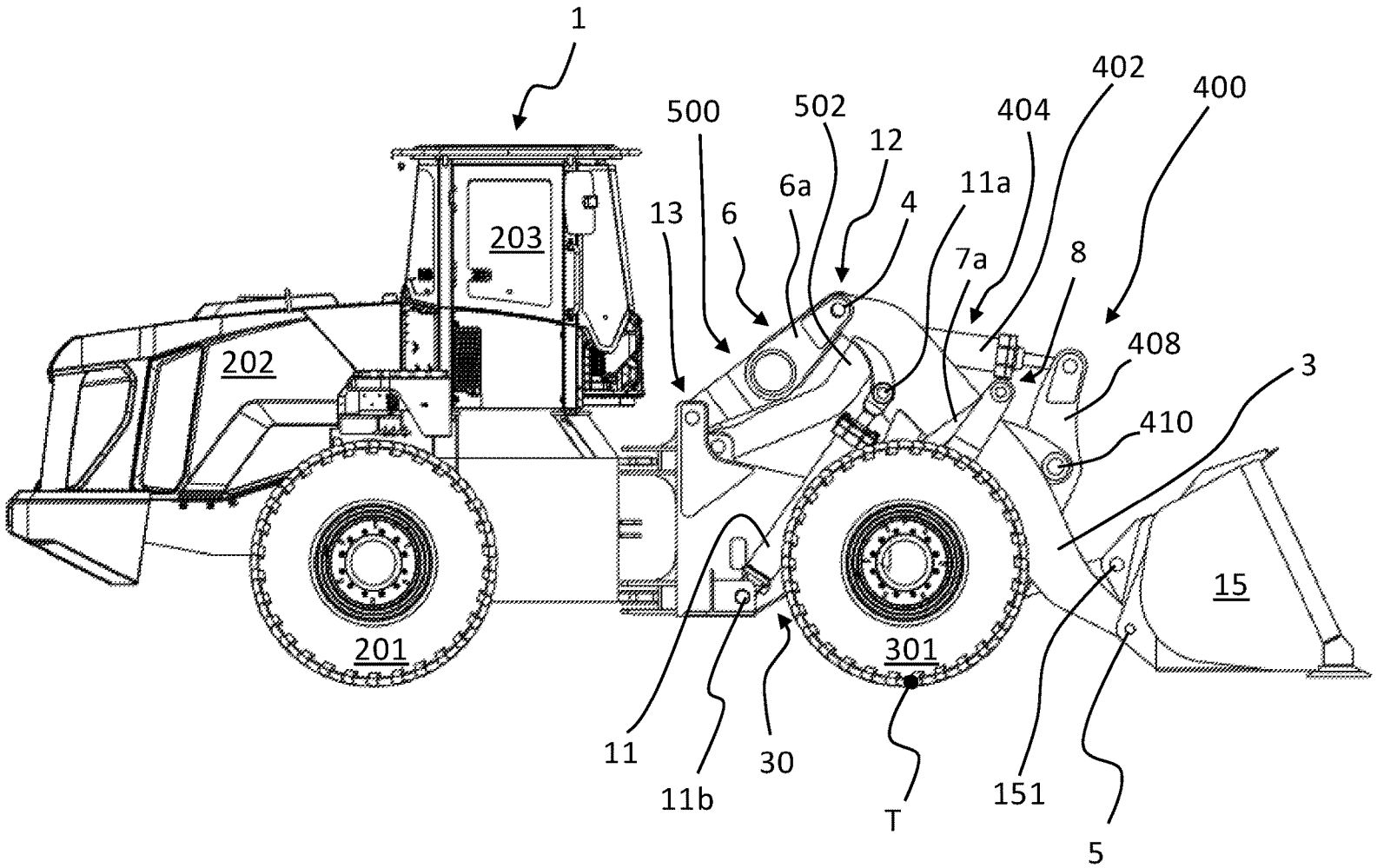
FIG. 28 illustrates a construction machine equipped with a lifting arrangement and a self-level mechanism according to a first embodiment.
Figure 29:
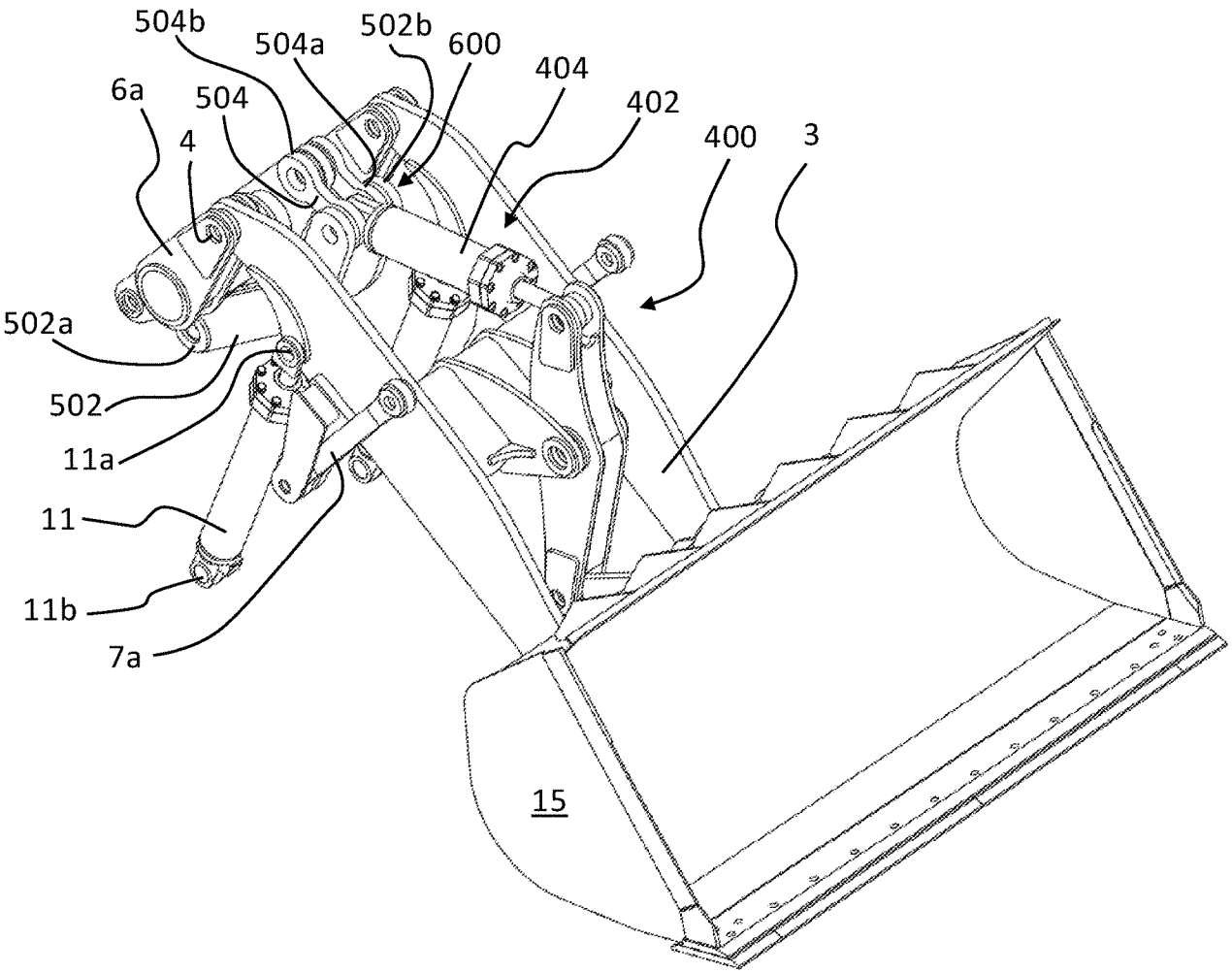
FIG. 29 illustrates a perspective view of the lifting arrangement and the self-level mechanism according to the first embodiment.
Figure 30:
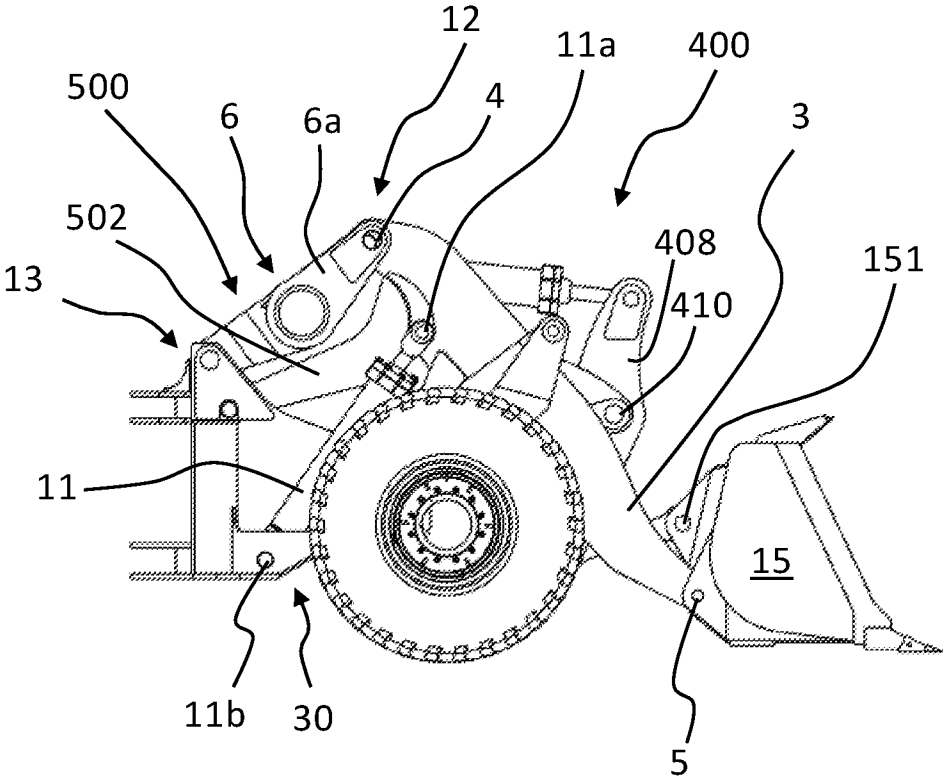
FIG. 30 illustrates a front portion of a construction machine equipped with the lifting arrangement and the self-level mechanism according to the first embodiment in a lowered position.

A further modification of the above mentioned examples which is also applicable to the above modifications is exemplary illustrated in FIGS. 25-27. As discussed above, the tilting arrangement for providing a tilting operation of the equipment, such as the bucket 15, is not illustrated in the drawings. FIG. 25 shows such an arrangement having a link mechanism 152 mounted to the tilt connector 151. The other end of the link mechanism 152 is mounted to an extension 154 via a bearing 153 provided at an element of the main arm support means 6 in the present case, at the main arm support link 6*a*. Based on such an arrangement, the tilt position of the equipment, such as the bucket 15 shown in FIG. 25, can be maintained constant throughout the lifting operation of the lifting arrangement shown in the sequence of FIGS. 25-27. While the lifting arrangement is in the lowered position in the illustration of FIG. 25, the position is in the intermediate position in FIG. 26 and reaches the maximum lift position in FIG. 27. As can be seen, the link mechanism 152 provides a constant tilt position of the equipment such as the bucket 15 shown in this example.

In addition, an actuating system can be provided for changing the tilt angle of the equipment which is not shown in the drawings. The link mechanism 152 can include or replaced by an actuator extending between the tilt connector 151 and the above mentioned bearing 153 of the main arm support element 6 in order to change the extension length between above mentioned elements. This actuator can be provided as linear actuator which is e.g. operated by hydraulic pressure in order to provide the tilting function of the bucket 15 or, as alternative, of the fork 16 or any other equipment mounted to the equipment connector 5.

The above modification relating to the tilt arrangement of the equipment is applicable to all above mentioned example and it is clear that slight modifications will be implemented by the skilled person in order to adapt to the specific concepts discussed above.

It is noted that the above mentioned examples and modifications can be combined freely with each other in order to provide further advantages resulting from such a combination of features.

Embodiments according to the present invention will be described in the following. It is noted that elements which are similar to elements of the lifting arrangements as described above are denoted with the same reference signs. For the sake of conciseness, an explanation of these elements is not repeated in detail. Rather, specific differences in the lifting arrangements, if present, will be discussed. In the following, it will be mainly focused on possible constructions and arrangements of self-level mechanisms according to the present invention. Such self-level mechanisms can be employed instead of the link mechanism 152 mounted to the tilt connector 151 as described above with reference to FIGS. 25 to 27 in order to provide an enhanced control of the tilt position of the equipment such as the bucket 15.

First Embodiment

A first embodiment of the present invention is described in the following with reference to FIGS. 28-35. A construction machine 1 exemplified as a wheel loader is shown. The wheel loader comprises a similar lifting arrangement as described with respect to FIG. 1 and it is referred to that Figure regarding a detailed explanation of the different elements of the construction machine 1 and the lifting arrangement.

In addition to the lifting arrangement, the construction machine 1 comprises a self-level mechanism for controlling a tilting movement of equipment 15 mounted to the equipment connector 5 of the main arm 3. The self-level mechanism is configured to provide a counter-rotation of the equipment 15 with respect to a pivoting movement of the main arm 3. In order to achieve such a counter-rotation, the self-level mechanism is kinematically coupled with the lifting arrangement and the equipment. Furthermore, the self-level mechanism is also kinematically coupled to the front frame portion 30 of the wheel loader 1.

The self-level mechanism comprises a kinematic chain with multiple linking devices and joints for connecting linking devices with each other. More precisely, the self-level mechanism comprises a first kinematic chain 400 which is coupled to the tilt connector 151 of the equipment 15 at one end. Furthermore, the self-level mechanism comprises a second kinematic chain 500 which is coupled to the first kinematic chain 400 at a coupling joint 600.

The main purpose of the second kinematic chain 500 is to effect a movement or adjust a position of the coupling joint 600 such that the coupling joint 600 changes its position relative to the equipment connected 5.

The first kinematic chain 400 which is coupled to the coupling joint 600 at one end transmits a movement as induced at the coupling joint 600 to the tilt connector 151 thereby effecting a rotational movement of the equipment 15 about the equipment connector 5. The construction of the first kinematic chain 400 can be gathered from FIGS. 28 to 34 and is shown in detail in FIG. 35.

In the present embodiment, the first kinematic chain 400 is configured as a Z-kinematic meaning that the direction in which a force which is received or generated at one end of the kinematic chain is generated in the opposite direction on the other end of the kinematic chain. That means that in case the pushing force is introduced in one end of the first kinematic chain 400, a pulling force is generated at the other end of the first kinematic chain 400. In order to achieve such a reversal, the first kinematic chain 400 according to the first embodiment comprises a reversal lever 408 which is rotatably coupled to the main arm 3 at a middle section 410 thereof. The reversal lever 408 is structured such that its ends 412, 414 are located on opposite sides of the middle section 410 and are consequently able to rotate about a rotational axis on opposite sides.

The first kinematic chain 400 further comprises an actuator 404 which is a hydraulic actuator in the present embodiment. The actuator 404 comprises a cylinder barrel 404*a* and a piston 404*b*. A free end portion of the piston 404*b* is coupled to the first end 412 of the reversal lever 408 and a free end of the cylinder barrel 404*a* is coupled to the coupling joint 600.

The second end 414 of the reversal lever 408 is coupled to a transmission lever or link 416 which in turn is coupled to the tilt connector 151 of the equipment 15.

According to the present embodiment, a movement of the coupling joint 600 effects a movement of the tilt connector 151. In this way, it is possible to generate a desired movement of the tilt connector 151 about the equipment connector such that a tilting movement of the equipment 15, which would occur upon pivoting the main arm 3, is at least partially compensated. Consequently, in order to achieve a compensating movement of the tilt connector 151 and thus of the equipment 15 about the equipment connector 5, a specific movement of the coupling joint 600 can be used.

According to the invention, it is preferable that the movement of the coupling joint 600 is enough for effecting the desired movement of the tilt connector 151. In other words, the movement of the coupling joint 600 and the construction of the first kinematic chain 400 are adapted to each other such that the compensating effect can be achieved without the need of activating the actuator 404.

In order to move the coupling joint 600 and to operate the first kinematic chain 400, the second kinematic chain 500 is provided as already mentioned above. The second kinematic chain 500 is kinematically coupled to the lifting arrangement such that a specific movement of the coupling joint 600 is achieved upon rotating the main arm 3 for lifting or lowering the equipment 5.

Figure 35:
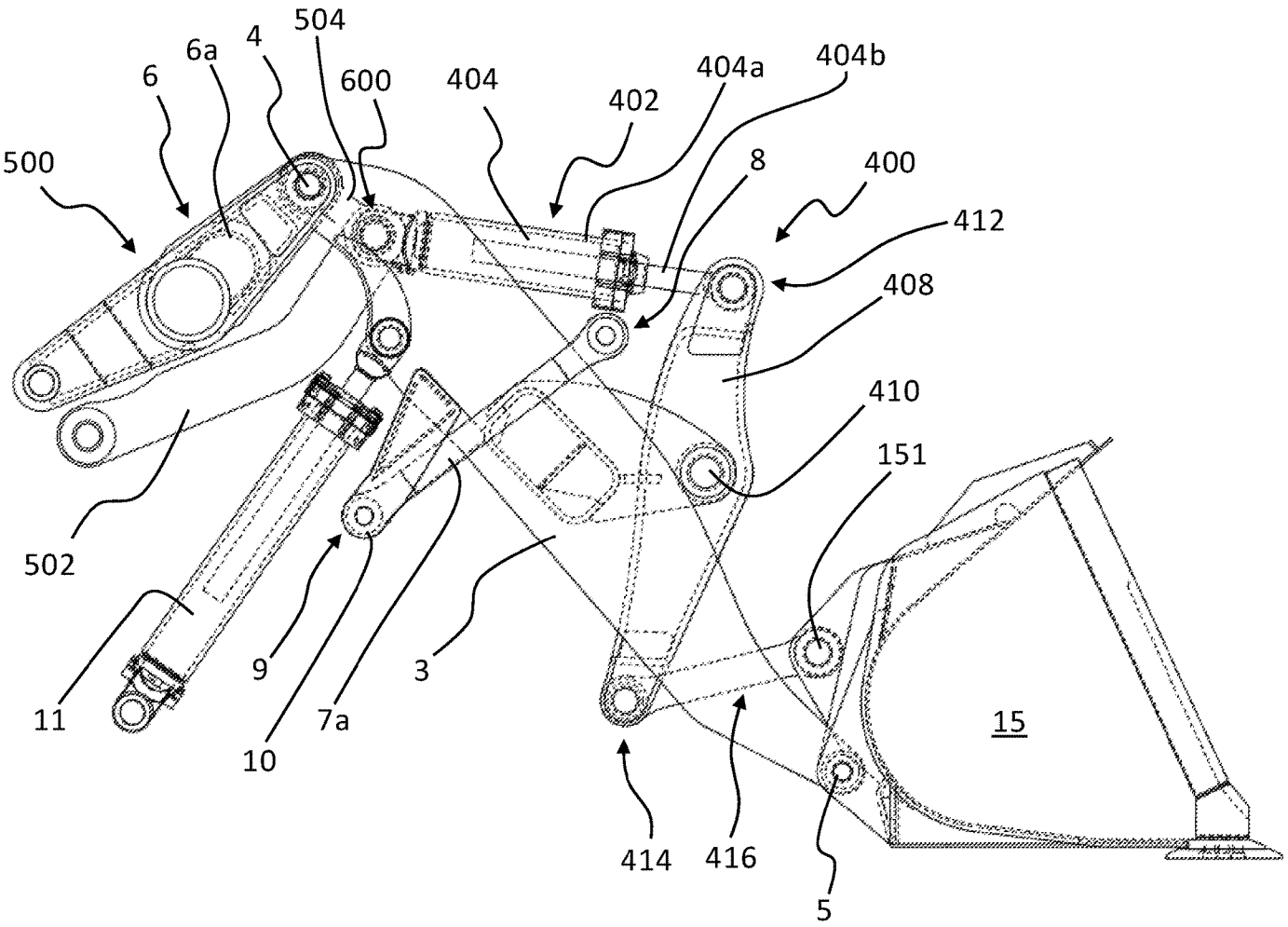
FIG. 35 illustrates a side view of the lifting arrangement and the self-level mechanism according to the first embodiment.
Figure 36:
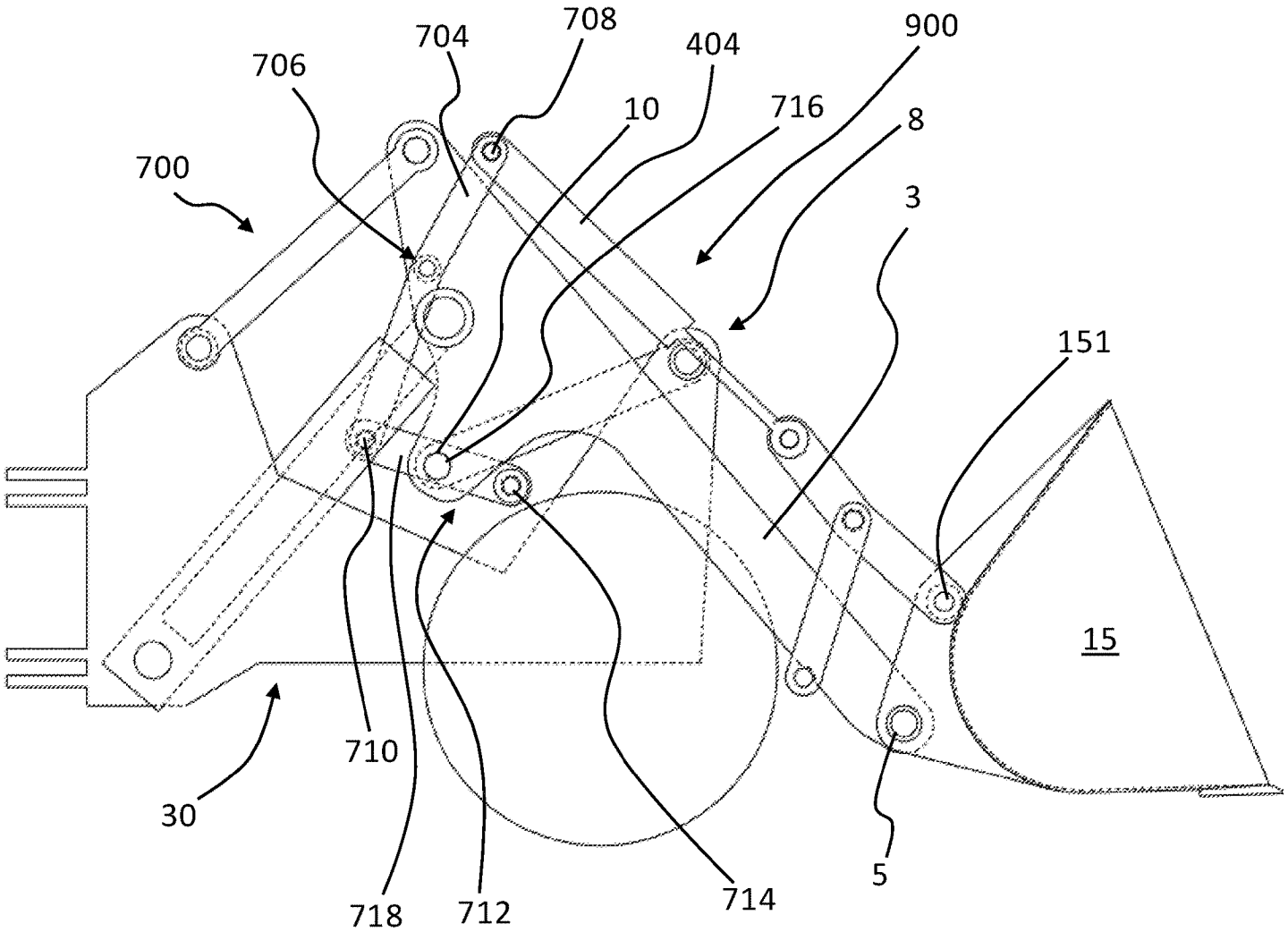
FIG. 36 illustrates a front portion of a construction machine equipped with a lifting arrangement and a self-level mechanism according to a second embodiment.
Figure 37:
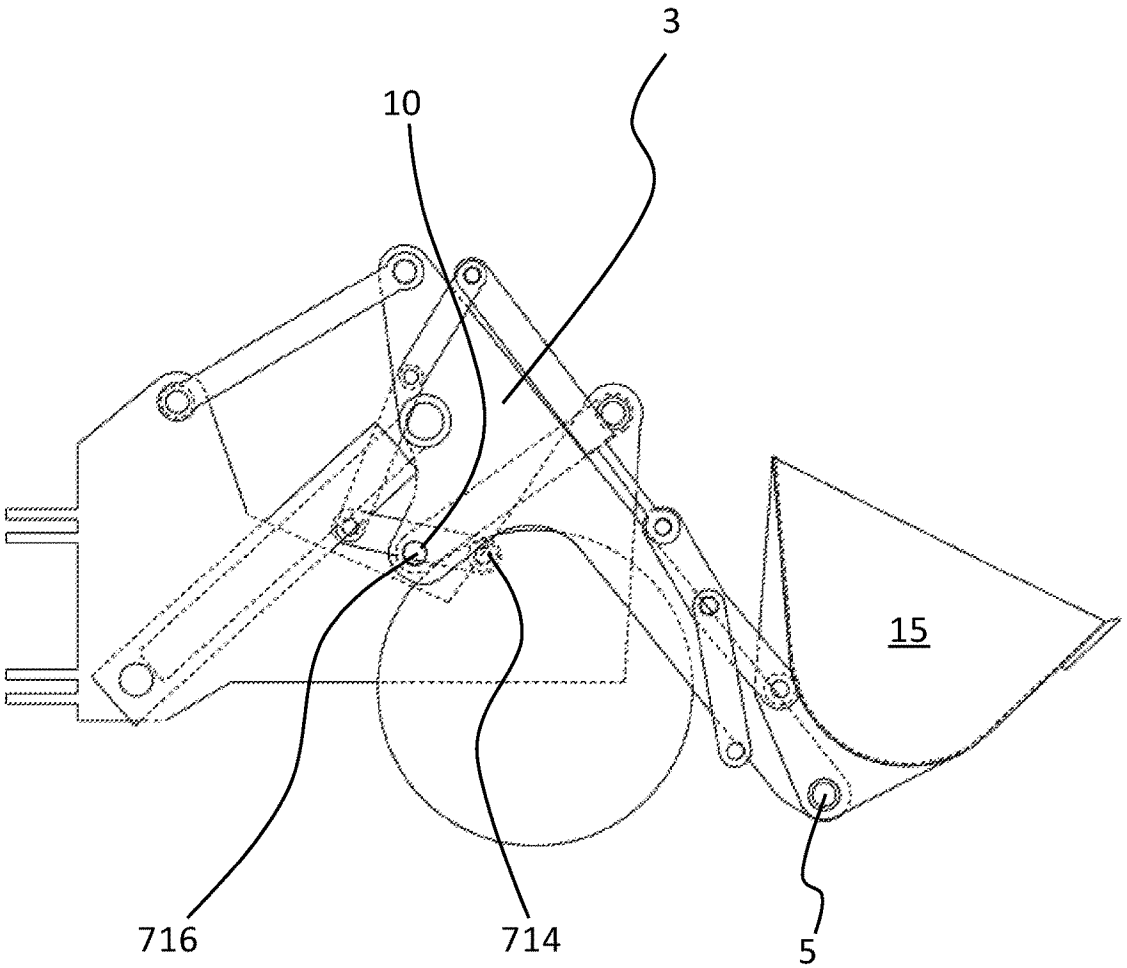
FIG. 37 illustrates a front portion of a construction machine equipped with the lifting arrangement and the self-level mechanism according to the second embodiment in a lowered position.
Figure 38:
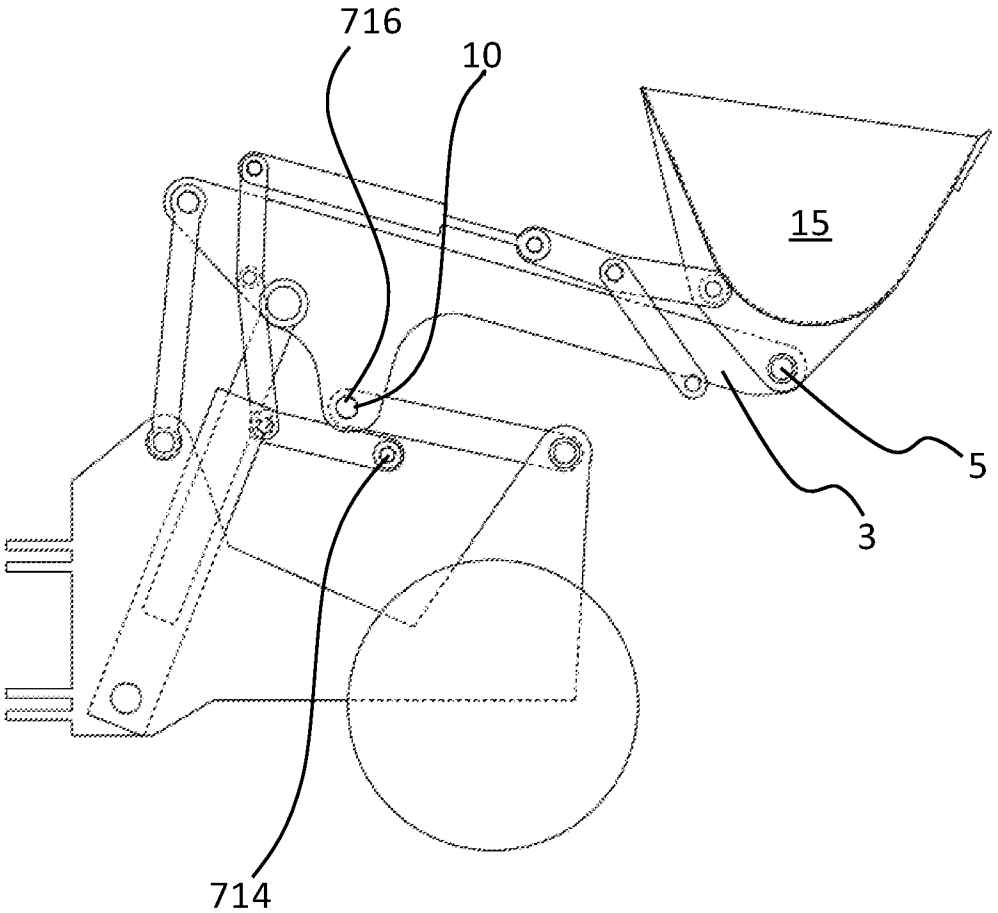
FIG. 38 illustrates a front portion of a construction machine equipped with the lifting arrangement and the self-level mechanism according to the second embodiment in an intermediate position.
Figure 39:
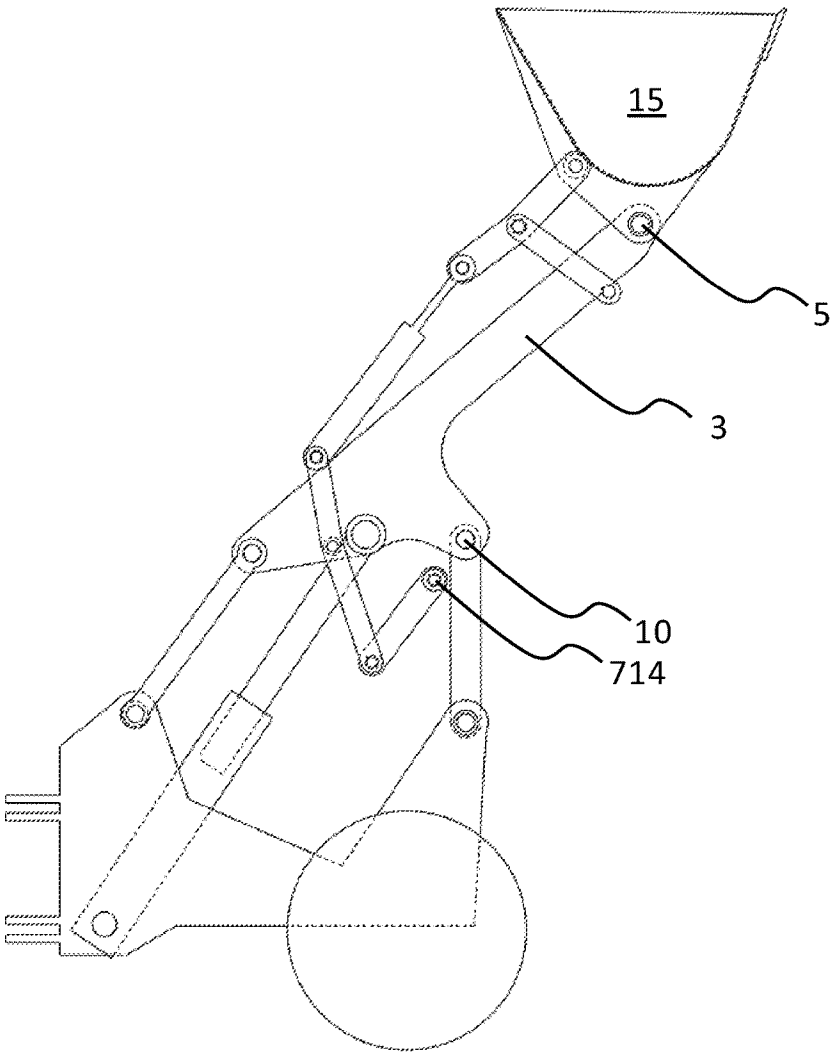
FIG. 39 illustrates a front portion of a construction machine equipped with the lifting arrangement and the self-level mechanism according to the second embodiment in a lifted position.

The second kinematic chain 500 according to the first embodiment comprises the main arm support element 6, an auxiliary link 502 and a guiding link 504. The main arm support element 6 is connected to pivot connector 4 and thus to the main arm 3 at its first end 12 and is connected to the frame portion 30 at the second end 13. The auxiliary link 502 is rotatably coupled to the frame portion 30 at a first end 502*a* thereof and is rotatably coupled to one end of the guiding link 504 at a second end 502*b*. A second end of the guiding link 504 is kinematically coupled to the lifting arrangement. More precisely, the second end of the guiding link 504 is coupled to lifting arrangement such that it is pivotable about an axis of said pivot connector 4 or an axis running parallel to said pivot connector. Furthermore, the second end 504*b* of the guiding link can be coupled to the main arm support element 6 such that the second end 504*b* of the guiding link 504 moves corresponding to a movement of the main arm support element 6. Furthermore, the auxiliary link 502 is designed and arranged to extend substantially parallel with the main arm support element 6 when viewed in a side view such as shown in FIG. 1, for instance. The first end 504*a* of the guiding link 504 and the second end 502*b* of the auxiliary link 502 are coupled with a cylinder barrel end of the actuator 404 and thus with the coupling joint 600. In other words, the coupling joint 600 is the portion where the latter elements are rotatably coupled. As is shown in FIG. 35, the links of the second kinematic chain 500 are arranged in the form of a parallelogram in which the support element 6 and the auxiliary link 502 are arranged substantially parallel. Furthermore, the second kinematic chain is closed.

Figure 31:
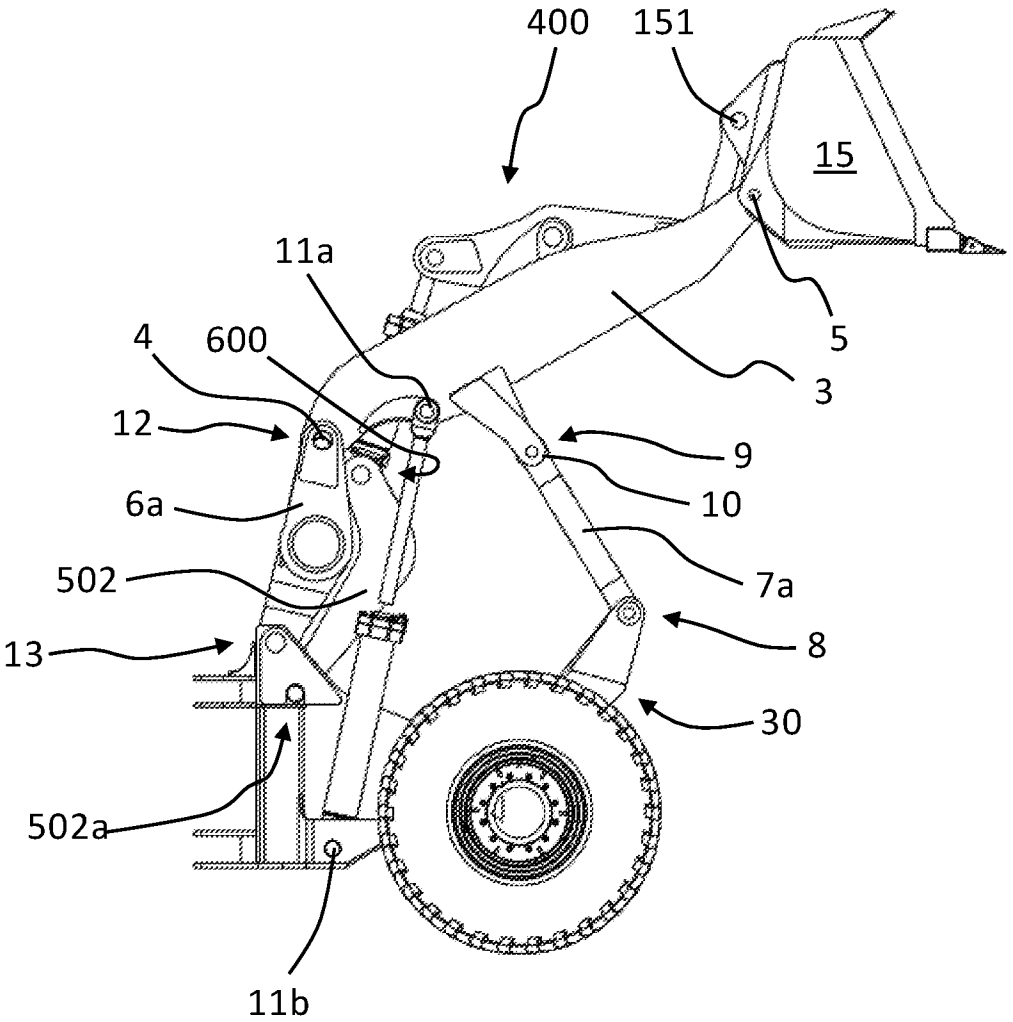
FIG. 31 illustrates a front portion of a construction machine equipped with the lifting arrangement and the self-level mechanism according to the first embodiment in a lifted position.
Figure 32:
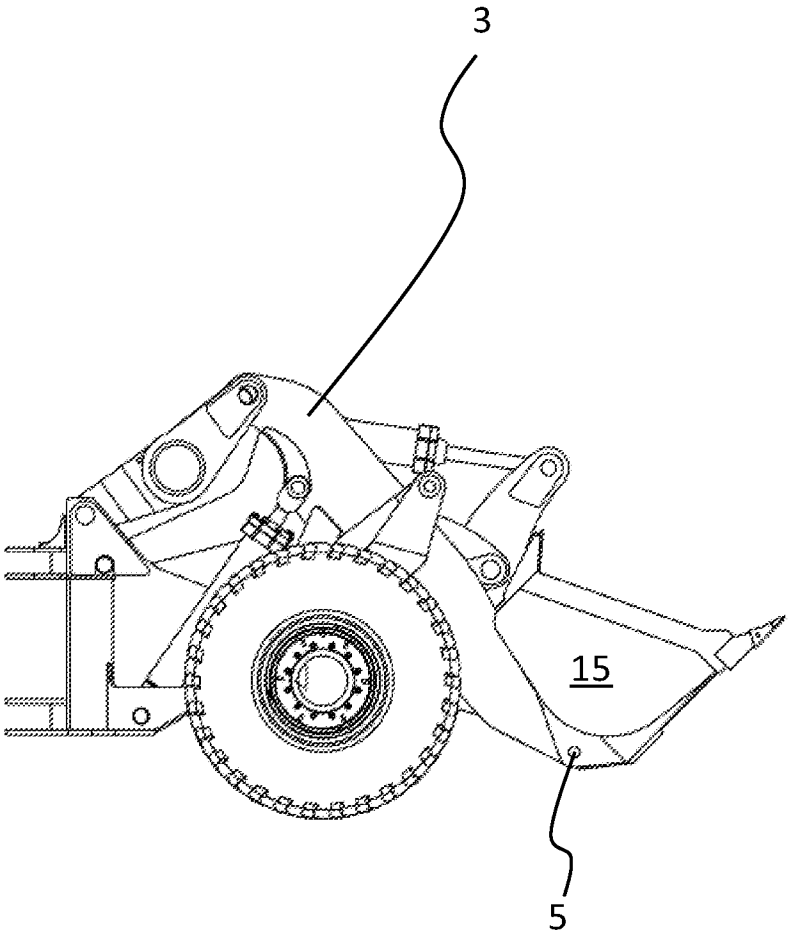
FIG. 32 illustrates a front portion of a construction machine equipped with the lifting arrangement and the self-level mechanism according to the first embodiment in a lowered position and with an equipment in a rolled back position.
Figure 33:
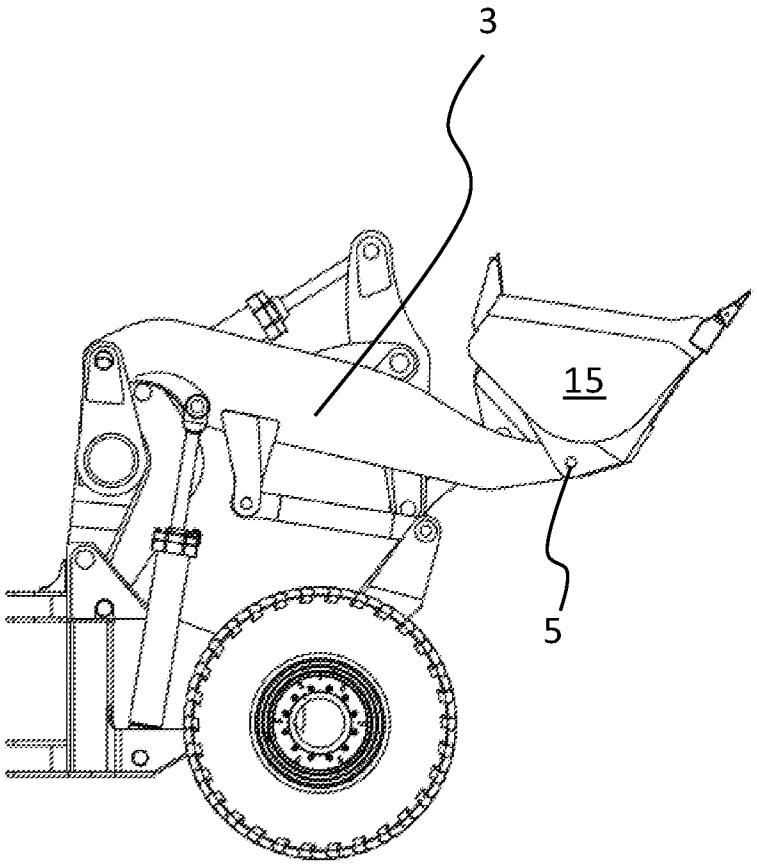
FIG. 33 illustrates a front portion of a construction machine equipped with the lifting arrangement and the self-level mechanism according to the first embodiment in an intermediate position and with an equipment in a rolled back position.
Figure 34:
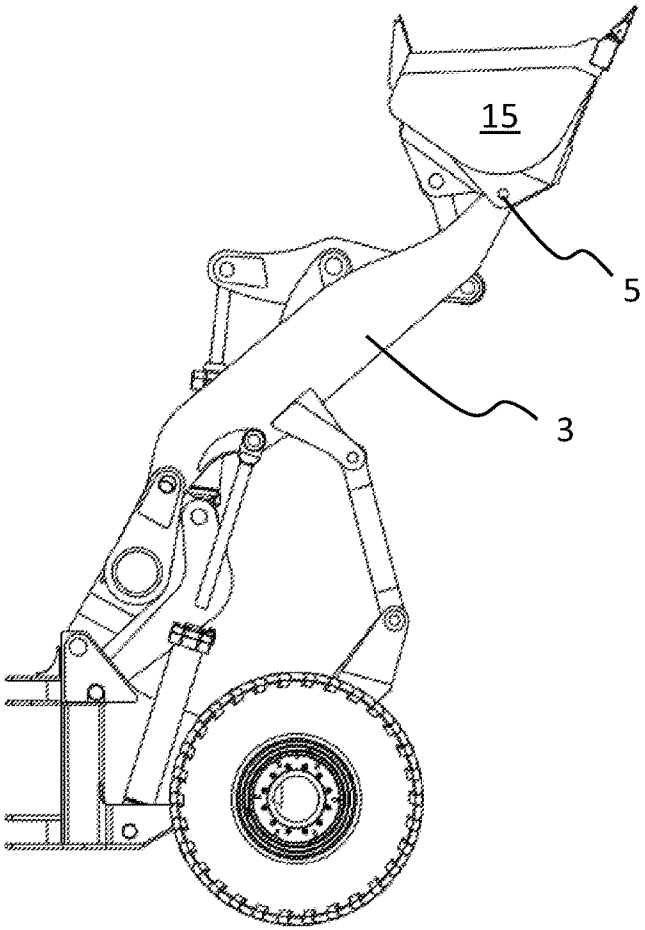
FIG. 34 illustrates a front portion of a construction machine equipped with the lifting arrangement and the self-level mechanism according to the first embodiment in a lifted position and with an equipment in a rolled back position.

The function of the self-level mechanism according to the first embodiment can be gathered from FIGS. 30-34 all of which showing states of a movement of the equipment 15 from a lowered position (FIG. 30, 32) over an intermediate position (FIG. 33) to a lifted position (FIGS. 31, 34). The difference between FIGS. 30 and 31 and FIGS. 32-34 resides in a different orientation of the bucket 15. The mechanical principle of the self-level mechanism is the same and the different orientations of the bucket are mainly shown for illustrating that the self-level mechanism works independently of the orientation of the equipment 5. The movement of the different links can be directly gathered from the Figures.

As is obvious from the construction of the self-level mechanism, a movement of the support element 6 leads to a corresponding movement of the second end 504*b* of the guiding link 504. Due to the linkage of the first end 504*a* of the guiding link 504 to the second end 502*b* of the auxiliary link 502 and due to the construction and arrangement of the auxiliary link 502, the guiding link 504 is rotated about the axis when the main arm 3 is moved. More precisely, the first end 504*a* is moved on a specific path leading to a movement of the coupling joint 600 thereby introducing a force into the first kinematic chain 400 which is transferred to the tilt connector 151.

As is obvious from the drawings, when moving the equipment 5 from the lowered position to the lifted position, the equipment has to be rotated in the clockwise direction in order to compensate for a tilting which would otherwise occur. Consequently, a pushing force needs to be exerted on the tilt connector 151 which, due to the construction of the first embodiment, means that the coupling joint needs to introduce a pulling force into the first kinematic chain 400. Accordingly, the guiding link 504 and the auxiliary link 502 are mounted such that the coupling joint 600 is moved correspondingly when the main arm 3 is lifted, i.e. rotated in the counterclockwise direction.

Second Embodiment

FIGS. 36-39 show a second embodiment of the present invention. In the second embodiment, the first and the second kinematic chain are structured differently compared to the kinematic chains as described in connection with the first embodiment. More precisely, the first kinematic chain 900 is structured such that a force is transferred without a directional reversal. The second kinematic chain 700 comprises several links 704, 712, 718 for transferring a movement of the guiding portion 10 of the main arm 3 to a cylinder barrel end of actuator 404 such that a tilting of the equipment 5 is compensated during a movement of the main arm 3. According to the second embodiment, the link 704 coupled to the cylinder barrel end of the actuator 404 is rotatably supported on the main arm 3 at a middle section 706 thereof. Furthermore, link 712 is not clearly shown in the Figures but is coupled to joints 714 and 716. Consequently, the end of link 718 which is coupled to joint 714 is guided about the guided portion 10 at a fixed distance. In this way, the movement of the main arm 3 causes a movement of joint 708. Thus, tilting of the equipment is controlled due to the construction of the kinematic chain according to the second embodiment.

Third Embodiment

Figure 40:
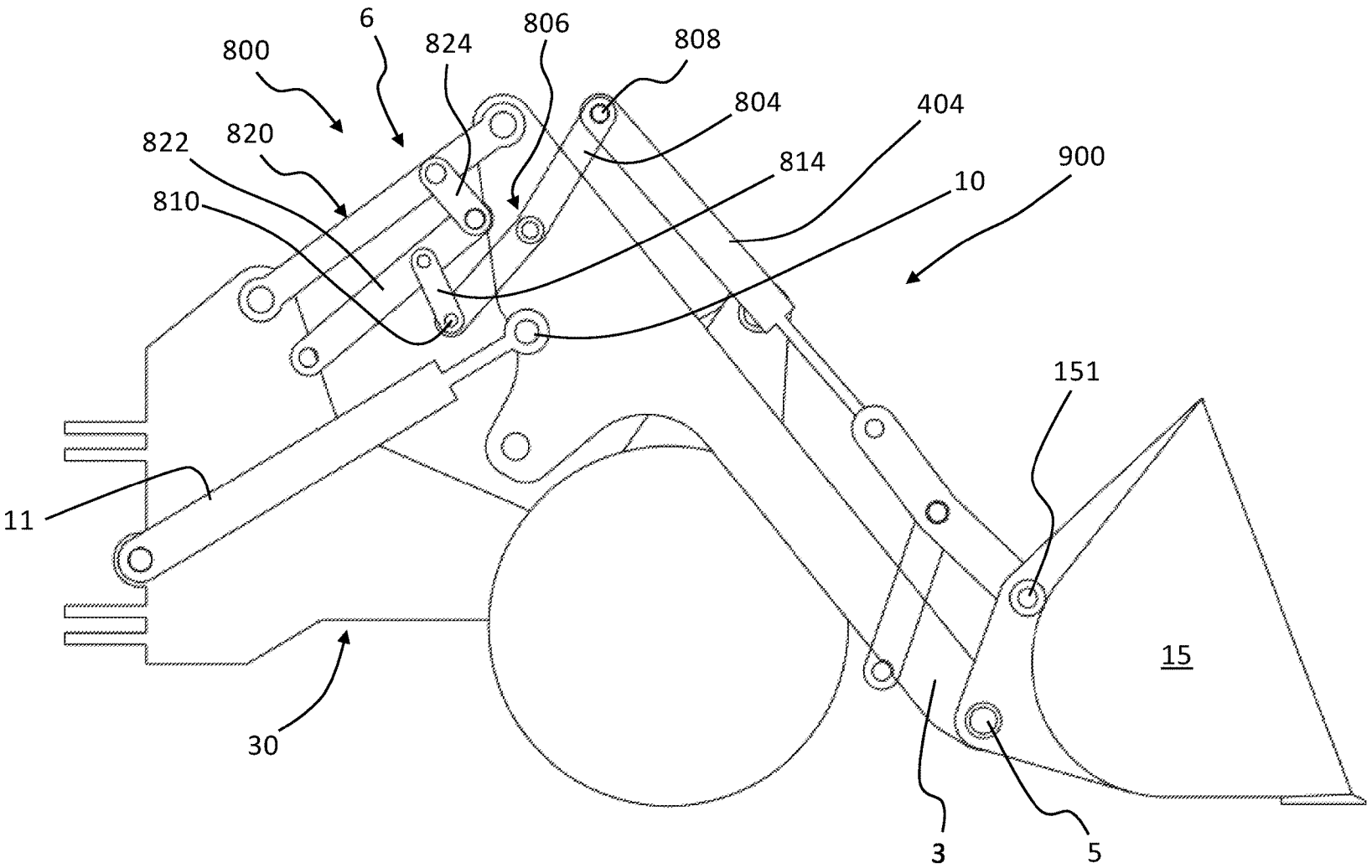
FIG. 40 illustrates a front portion of a construction machine equipped with a lifting arrangement and a self-level mechanism according to a third embodiment.

A third embodiment according to the invention is shown in FIG. 40. The first kinematic chain 900 corresponds to the first kinematic chain 900 according to the second embodiment. The second kinematic chain 800 according to this embodiment comprises a more complex mechanism comprising multiple links 804, 814, 822, 824. Link 804 is coupled to the cylinder barrel end of the actuator 404 at joint 808 and is rotatably supported on the main arm 3 at a middle section 806 thereof. At joint 810, link 804 is coupled to link 814 which in turn is coupled to a parallelogram kinematic 820. More precisely, link 814 is coupled to a middle section of link 822 of the parallelogram kinematic 820. The parallelogram kinematic further includes link 824 which couples link 822 to the support arm 6. The link 804 of the second kinematic chain 800 is rotatably coupled to the main arm 3 at a supporting portion 806 arranged between joints 808, 810 of link 804. Link 804 is coupled to the first kinematic chain 900 at joint 808 which corresponds to a coupling joint 600. Furthermore, joint 804 is coupled to the frame structure 30 by means of the parallelogram kinematic 820.

Further Embodiments and Modifications

Figure 41:
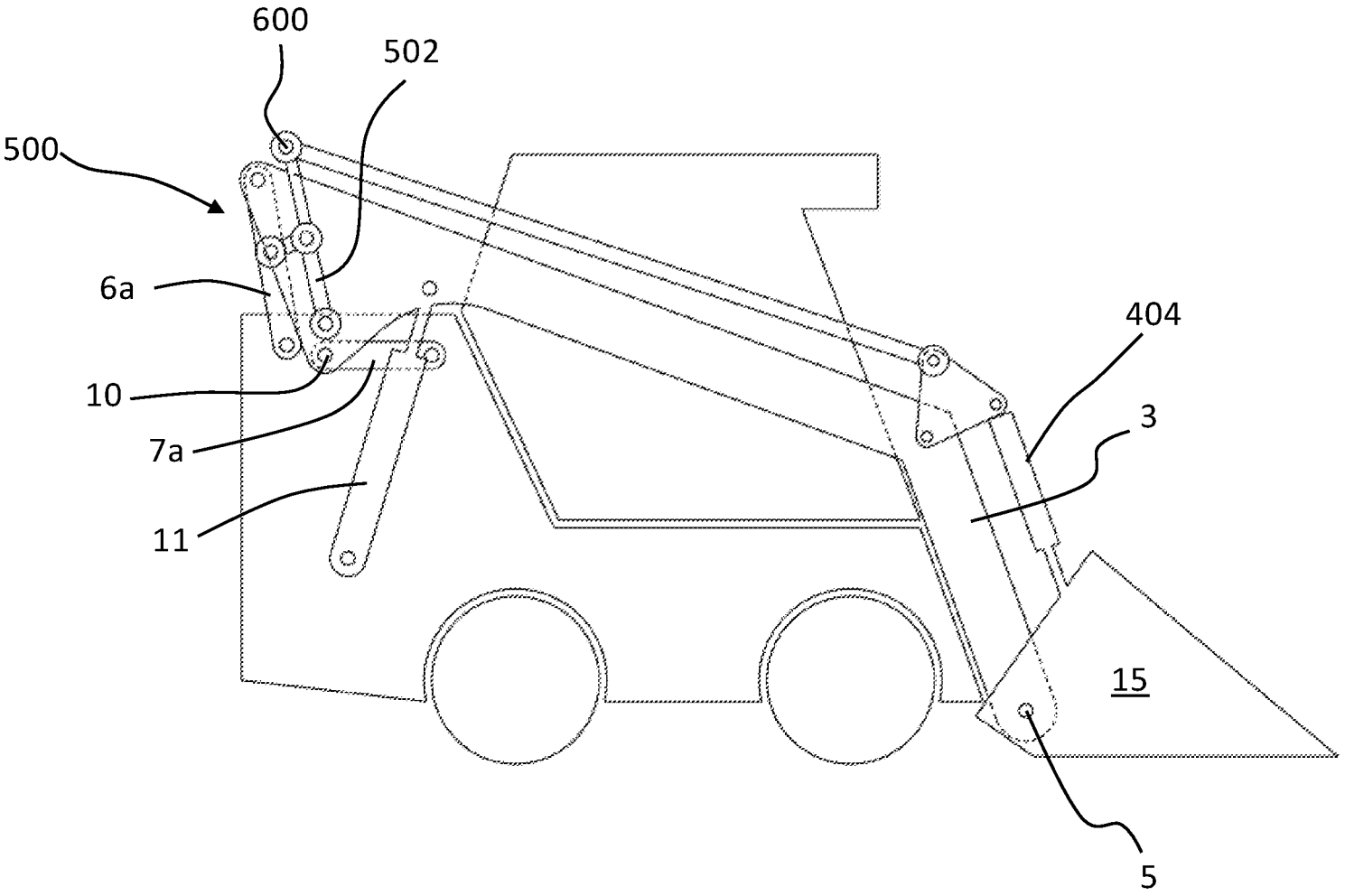
FIG. 41 illustrates a front portion of a construction machine equipped with a lifting arrangement and a self-level mechanism according to a fourth embodiment.

As is shown in FIG. 41, a self-level mechanism similar to the ones described above can also be used in a compact loader although not explained in detail here. A person skilled in the aft will recognize the function and construction from FIG. 41. The reference signs are merely exemplary and indicate which elements correspond to elements according to the embodiments described above.

It is explicitly noted that the present invention is generally usable with all of the above described lifting arrangements. In other words, the self-level mechanism can be suitably applied in combination with lifting arrangements in which a pivoting movement of the main arm would cause a tilting movement of the equipment and in which it is not desired to use an actuator for tilt compensation. The present invention relates also to construction machines comprising one of the above described lifting arrangements and one of the above described self-level mechanisms. A skilled person will immediately recognize necessary adaptations of the self-level mechanism, if any, for use with lifting arrangements as described above.

Instead of using rigid and non-length adjustable links for providing the lifting function of the lifting arrangements as described above, it is noted that it is also possible to use an actuator and a specific control for generating the specific lifting movement of the lifting arrangements as disclosed above. For example, it is possible to substitute the guiding arm 7*a* as shown in FIG. 35 by an actuator and to couple the actuator with the main arm support means 6 at a middle section thereof. With such a construction, it is possible to control a movement of the guided portion 10 and consequently a movement of the main arm 3 about the pivot connector 4 by controlling the actuator in a specific way. In this way, a complex mechanical arrangement can be substituted by an actuator in an alternative.

The invention claimed is:

1. A lifting arrangement for a construction machine, comprising:

a main arm with an equipment connector; and a self-level mechanism for controlling a tilting movement of equipment mounted to said equipment connector upon pivoting said main arm, wherein said self-level mechanism is configured to at least partially compensate any tilting movement of said equipment, wherein said self-level mechanism comprises a first kinematic chain coupleable to a tilt connector of said equipment at one end, wherein said self-level mechanism further comprises a second kinematic chain coupled to said first kinematic chain at a coupling joint and coupleable to at least one of a frame portion of said construction machine and said main arm of said lifting arrangement, and wherein said second kinematic chain is configured such that a distance between said coupling joint and said equipment connector changes upon pivoting said main arm, wherein said second kinematic chain comprises a support element of said lifting arrangement, said support element being connected to said main arm at a pivot connector provided on said main arm at one end and being connectable to said frame portion at another end, and an auxiliary link directly coupled to said coupling joint at one end and coupleable to said frame portion at the other end.

2. The lifting arrangement according to claim 1, wherein said self-level mechanism is configured so as to provide a counter-rotation of said equipment with respect to a pivoting movement of said main arm.

3. The lifting arrangement according to claim 2, wherein said first kinematic chain is configured as a Z-kinematic.

4. The lifting arrangement according to claim 3, wherein said first kinematic chain comprises an actuator.

5. The lifting arrangement according to claim 3, wherein at least one linking device of said first kinematic chain is length adjustable.

6. The lifting arrangement according to claim 1, wherein said coupling joint is arranged rotatably about an axis of a pivot connector provided on said main arm.

7. The lifting arrangement according to claim 6, wherein said second kinematic chain is a closed kinematic chain in a form of a parallelogram in which said support element and said auxiliary link are arranged substantially parallel to each other.

8. The lifting arrangement according to claim 1, wherein at least one linking device of said second kinematic chain is rotatably coupled to said main arm at a supporting portion arranged between two joints of said at least one linking device.

9. The lifting arrangement according to claim 8, wherein said second kinematic chain is configured such that two links of said second kinematic chain are rotatably coupled to said main arm.

10. The lifting arrangement according to claim 8, wherein said at least one linking device is coupled to the first kinematic chain at one joint of said two joints, said joint functioning as said coupling joint and coupleable to said frame portion of said construction machine via a parallelogram kinematic.

11. The lifting arrangement according to claim 10, wherein said one joint is operatively coupled to said parallelogram kinematic at a middle section of a parallelogram kinematic link by means of an intermediate link.

12. A construction machine having a frame arrangement, said construction machine comprising:

a lifting arrangement mounted to said frame arrangement, said lifting arrangement comprising:

a main arm which is provided with a pivot connector at a proximate end thereof and an equipment connector at a distal end thereof, a main arm support means for pivotably supporting said pivot connector of said main arm, wherein said main arm support means is movable in a direction which includes at least a component in a front-rear direction with respect to said frame arrangement, an actuator for pivoting said main arm about said pivot connector such that said equipment connector is movable between a lowered position and a lifted position, and a guiding means which is engaged to said main arm at a guided portion of said main arm positioned between said pivot connector and said equipment connector, wherein upon pivoting said main arm between said lowered position and said lifted position, said guided portion is guided by said guiding means along a curved path; and a self-level mechanism for controlling a tilting movement of equipment mounted to said equipment connector, said self-level mechanism comprising:

a first kinematic chain coupleable to a tilt connector of said equipment at one end; and a second kinematic chain coupled to said first kinematic chain at a coupling joint and coupleable to at least one of said frame arrangement or said main arm of said lifting arrangement, wherein said second kinematic chain is configured such that a distance between said coupling joint and said equipment connector changes upon pivoting said main arm, and wherein said second kinematic chain comprises a support element of said lifting arrangement, said support element being connected to said main arm at a pivot connector provided on said main arm at one end and being connectable to said frame arrangement at another end, and an auxiliary link directly coupled to said coupling joint at one end and coupleable to said frame arrangement at the other end.

13. The construction machine according to claim 12, wherein said self-level mechanism is configured so as to provide a counter-rotation of said equipment with respect to a pivoting movement of said main arm.

14. The construction machine according to claim 12, wherein said first kinematic chain is configured as a Z-kinematic.

15. The construction machine according to claim 12, wherein at least one linking device of said first kinematic chain is length adjustable.

16. A construction machine comprising a lifting arrangement, wherein the construction machine is a wheel loader having a frame arrangement with a front frame portion and a rear frame portion, said construction machine comprising:

a lifting arrangement mounted to said frame arrangement, said lifting arrangement comprising:

a main arm which is provided with a pivot connector at a proximate end thereof and an equipment connector at a distal end thereof, a main arm support means for pivotably supporting said pivot connector of said main arm, wherein said main arm support means is movable in a direction which includes at least a component in a front-rear direction with respect to said frame arrangement, an actuator for pivoting said main arm about said pivot connector such that said equipment connector is movable between a lowered position and a lifted position, and a guiding means which is engaged to said main arm at a guided portion of said main arm positioned between said pivot connector and said equipment connector, wherein upon pivoting said main arm between said lowered position and said lifted position, said guided portion is guided by said guiding means along a curved path; and a self-level mechanism for controlling a tilting movement of an equipment mounted to said equipment connector, said self-level mechanism comprising:

a first kinematic chain coupleable to a tilt connector of said equipment at one end; and a second kinematic chain coupled to said first kinematic chain at a coupling joint and coupleable to at least one of said front frame portion, said rear frame portion, or said main arm of said lifting arrangement, wherein said second kinematic chain is configured such that a distance between said coupling joint and said equipment connector changes upon pivoting said main arm, and wherein said second kinematic chain comprises a support element of said lifting arrangement, said support element being connected to said main arm at a pivot connector provided on said main arm at one end and being connectable to said frame arrangement at another end, and an auxiliary link directly coupled to said coupling joint at one end and coupleable to said frame arrangement at the other end.

17. The construction machine according to claim 16, wherein said self-level mechanism is configured so as to provide a counter-rotation of said equipment with respect to a pivoting movement of said main arm.

18. The construction machine according to claim 16, wherein said first kinematic chain is configured as a Z-kinematic.

19. The construction machine according to claim 16, wherein at least one linking device of said first kinematic chain is length adjustable.

* * * * *